US011062637B2

(12) United States Patent
Jeong et al.

(10) Patent No.: US 11,062,637 B2
(45) Date of Patent: Jul. 13, 2021

(54) DISPLAY DEVICE AND METHOD OF DRIVING THE SAME

(71) Applicant: Samsung Display Co., Ltd., Yongin-Si (KR)

(72) Inventors: Geun Young Jeong, Busan (KR); Weon Jun Choe, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/807,018

(22) Filed: Mar. 2, 2020

(65) Prior Publication Data

US 2020/0365070 A1 Nov. 19, 2020

(30) Foreign Application Priority Data

May 13, 2019 (KR) ..... 10-2019-0055826

(51) Int. Cl.
*G09G 5/02* (2006.01)
*G09G 3/20* (2006.01)

(52) U.S. Cl.
CPC ... *G09G 3/2003* (2013.01); *G09G 2300/0452* (2013.01); *G09G 2310/027* (2013.01); *G09G 2310/0291* (2013.01); *G09G 2320/0673* (2013.01)

(58) Field of Classification Search
CPC ..... G09G 3/2003; G09G 2300/0452; G09G 2310/027; G09G 2310/0291
USPC ..... 345/695
See application file for complete search history.

(56) References Cited

U.S. PATENT DOCUMENTS

| | | | | |
|---|---|---|---|---|
| 9,117,398 | B2 | 8/2015 | Jeong et al. | |
| 9,542,875 | B2 | 1/2017 | Yang et al. | |
| 2008/0186325 | A1* | 8/2008 | Higgins | G06T 11/001 345/592 |
| 2015/0015600 | A1* | 1/2015 | Yang | G09G 3/2003 345/600 |
| 2016/0133174 | A1* | 5/2016 | Jeong | G09G 5/06 345/693 |

FOREIGN PATENT DOCUMENTS

KR 10-1332495 B1 11/2013

* cited by examiner

*Primary Examiner* — Jonathan M Blancha
(74) *Attorney, Agent, or Firm* — Innovation Counsel LLP

(57) ABSTRACT

A display device includes a display unit including a first pixel having a first color sub-pixel and a second color sub-pixel and a second pixel having a third color sub-pixel and another second color sub-pixel, an input gamma unit that converts first through third color grayscale data into first through third color luminance data, a buffer unit that stores the first through third color luminance data of a last pixel-column, a vertical rendering unit that increases the first and third color luminance data of the last pixel-column by using the first through third color luminance data of the last pixel-column as first and third color luminance data of an absent pixel-column adjacent to the last pixel-column, and an output gamma unit that converts the first through third color luminance data into the first and second color grayscale data or the third and second color grayscale data.

20 Claims, 19 Drawing Sheets

DISPLAY DEVICE AND METHOD OF DRIVING THE SAME

CROSS-REFERENCE TO RELATED APPLICATION

This application claims priority under 35 USC § 119 to Korean Patent Application No. 10-2019-0055826 filed on May 13, 2019 in the Korean Intellectual Property Office (KIPO), the entire disclosure of which is incorporated herein by reference.

BACKGROUND

1. Field

Example embodiments of the present inventive concept relate to a display device and a method of driving the display device for improving display quality.

2. Description of the Related Art

In recent years, flat panel display devices have been widely used as display devices. A particular type of flat panel display device, the organic light emitting display device, has garnered much interest as a next-generation display device because it is relatively thin and light, consumes relatively low power, and has relatively high response speed.

The organic light emitting display device may include a number of thin film transistors and an organic light emitting element connected to the thin film transistors. The organic light emitting element may emit light having a luminance corresponding to a voltage supplied to the organic light emitting element through the thin film transistor.

A pixel of the display device may include red, green, and blue sub-pixels. In general, the pixel has a stripe structure in which red, green, and blue sub-pixels are arranged in a vertical direction is common. Meanwhile, unlike the stripe structure, the pixel may have a pentile structure in which the pixel includes red and green sub-pixels or blue and green sub-pixels.

In the display device having the pentile structure, a rendering method is applied to convert input data including red, green, and blue data into output data including red and green data or blue and green data in accordance with the pentile structure.

SUMMARY

Some example embodiments provide a display device having a pentile structure that can improve display quality.

Some example embodiments provide a method of driving the display device.

According to example embodiments, a display device may include a display unit including a first pixel having a first color sub-pixel and a second color sub-pixel and a second pixel having a third color sub-pixel and another second color sub-pixel, an input gamma unit configured to convert first color grayscale data, second color grayscale data, and third color grayscale data into first color luminance data, second color luminance data, and third color luminance data, a buffer unit configured to store the first color luminance data, the second color luminance data, and the third color luminance data of a last pixel column of the display unit, a vertical rendering unit configured to increase the first color luminance data and the third color luminance data of the last pixel column by using the first color luminance data, the second color luminance data, and the third color luminance data of the last pixel column stored in the buffer unit as first color luminance data and third color luminance data of an absent pixel column adjacent to the last pixel column, and an output gamma unit configured to convert the first color luminance data, the second color luminance data, and the third color luminance data into the first color grayscale data and the second color grayscale data or the third color grayscale data and the second color grayscale data.

In example embodiments, the display device may further include a normal rendering unit configured to distribute the first color luminance data and the third color luminance data by applying a one-dimensional sub-pixel rendering filter to the first color luminance data and the third color luminance data of the first and second pixels.

In example embodiments, the vertical rendering unit may distribute the first color luminance data and the third color luminance data of the last pixel column and the absent pixel column by applying a two-dimensional sub-pixel rendering filter to the first color luminance data and the third color luminance data of the last pixel column and the absent pixel column, may add up the distributed first color luminance data of the absent pixel column to the distributed first color luminance data of the last pixel column, and may add up the distributed third color luminance data of the absent pixel column to the distributed third color luminance data of the last pixel column.

In example embodiments, a sum of filter coefficients of the two-dimensional sub-pixel rendering filter may be greater than or equal to 1.

In example embodiments, the display device may further include a normal rendering unit configured to distribute the first color luminance data and the third color luminance data by applying a first two-dimensional sub-pixel rendering filter to the first color luminance data and the third color luminance data of the first and second pixels.

In example embodiments, the buffer unit may further store first color luminance data, second color luminance data, and third color luminance data of a last pixel row of the display unit.

In example embodiments, the vertical rendering unit may distribute the first color luminance data and the third color luminance data of the last pixel column and the absent pixel column by applying a second two-dimensional sub-pixel rendering filter to the first color luminance data and the third color luminance data of the last pixel column and the absent pixel column, may add up the distributed first color luminance data of the absent pixel column to the distributed first color luminance data of the last pixel column, and may add up the distributed third color luminance data of the absent pixel column to the distributed third color luminance data of the last pixel column.

In example embodiments, a sum of filter coefficients of the second two-dimensional sub-pixel rendering filter may be greater than or equal to 1.

In example embodiments, the display device may further include a horizontal rendering unit configured to increase the first color luminance data and the third color luminance data of the last pixel row by using the first color luminance data, the second color luminance data, and the third color luminance data of the last pixel row stored in the buffer unit as first color luminance data and third color luminance data of an absent pixel row adjacent to the last pixel row.

In example embodiments, the horizontal rendering unit may distribute the first color luminance data and the third color luminance data of the last pixel row and the absent pixel row by applying a third two-dimensional sub-pixel rendering filter to the first color luminance data and the third color luminance data of the last pixel row and the absent pixel row, may add up the distributed first color luminance data of the absent pixel row to the distributed first color luminance data of the last pixel row, and may add up the distributed third color luminance data of the absent pixel row to the distributed third color luminance data of the last pixel row.

In example embodiments, a sum of filter coefficients of the third two-dimensional sub-pixel rendering filter may be greater than or equal to 1.

According to example embodiments, a method of driving a display device including a display unit that includes a first pixel having a first color sub-pixel and a second color sub-pixel and a second pixel having a third color sub-pixel and another second color sub-pixel may include converting first color grayscale data, second color grayscale data, and third color grayscale data into first color luminance data, second color luminance data, and third color luminance data, storing first color luminance data, second color luminance data, and third color luminance data of a last pixel column of the display unit in a buffer unit, increasing the first color luminance data and the third color luminance data of the last pixel column by using the first color luminance data, the second color luminance data, and the third color luminance data of the last pixel column stored in the buffer unit as first color luminance data and third color luminance data of an absent pixel column adjacent to the last pixel column, and converting the first color luminance data, the second color luminance data, and the third color luminance data into the first color grayscale data and the second color grayscale data or the third color grayscale data and the second color grayscale data.

In example embodiments, the method may further include distributing the first color luminance data and the third color luminance data by applying a one-dimensional sub-pixel rendering filter to the first color luminance data and the third color luminance data of the first and second pixels.

In example embodiments, the method may further include distributing the first color luminance data and the third color luminance data of the last pixel column and the absent pixel column by applying a two-dimensional sub-pixel rendering filter to the first color luminance data and the third color luminance data of the last pixel column and the absent pixel column, adding up the distributed first color luminance data of the absent pixel column to the distributed first color luminance data of the last pixel column, and adding up the distributed third color luminance data of the absent pixel column to the distributed third color luminance data of the last pixel column.

In example embodiments, the method may further include distributing the first color luminance data and the third color luminance data by applying a first two-dimensional sub-pixel rendering filter to the first color luminance data and the third color luminance data of the first and second pixels.

In example embodiments, the method may further include distributing the first color luminance data and the third color luminance data of the last pixel column and the absent pixel column by applying a second two-dimensional sub-pixel rendering filter to the first color luminance data and the third color luminance data of the last pixel column and the absent pixel column, adding up the distributed first color luminance data of the absent pixel column to the distributed first color luminance data of the last pixel column, and adding up the distributed third color luminance data of the absent pixel column to the distributed third color luminance data of the last pixel column.

In example embodiments, the method may further include storing first color luminance data, second color luminance data, and third color luminance data of a last pixel row of the display unit in the buffer unit.

In example embodiments, the method may further include increasing the first color luminance data and the third color luminance data of the last pixel row by using the first color luminance data, the second color luminance data, and the third color luminance data of the last pixel row stored in the buffer unit as first color luminance data and third color luminance data of an absent pixel row adjacent to the last pixel row.

In example embodiments, the method may further include distributing the first color luminance data and the third color luminance data of the last pixel row and the absent pixel row by applying a third two-dimensional sub-pixel rendering filter to the first color luminance data and the third color luminance data of the last pixel row and the absent pixel row, adding up the distributed first color luminance data of the absent pixel row to the distributed first color luminance data of the last pixel row, and adding up the distributed third color luminance data of the absent pixel row to the distributed third color luminance data of the last pixel row.

In example embodiments, a sum of filter coefficients of each of the second and third two-dimensional sub-pixel rendering filters may be greater than or equal to 1.

Therefore, a display device and a method of driving the display device according to example embodiments may prevent a luminance distribution defect caused by a physical pixel shortage at vertical and horizontal edge regions of a display unit by increasing red and blue luminance data of a last pixel column and a last pixel row of the display unit.

DETAILED DESCRIPTION OF THE EMBODIMENTS

Illustrative, non-limiting exemplary embodiments will be more clearly understood from the following detailed description in conjunction with the accompanying drawings.

Figure 1:
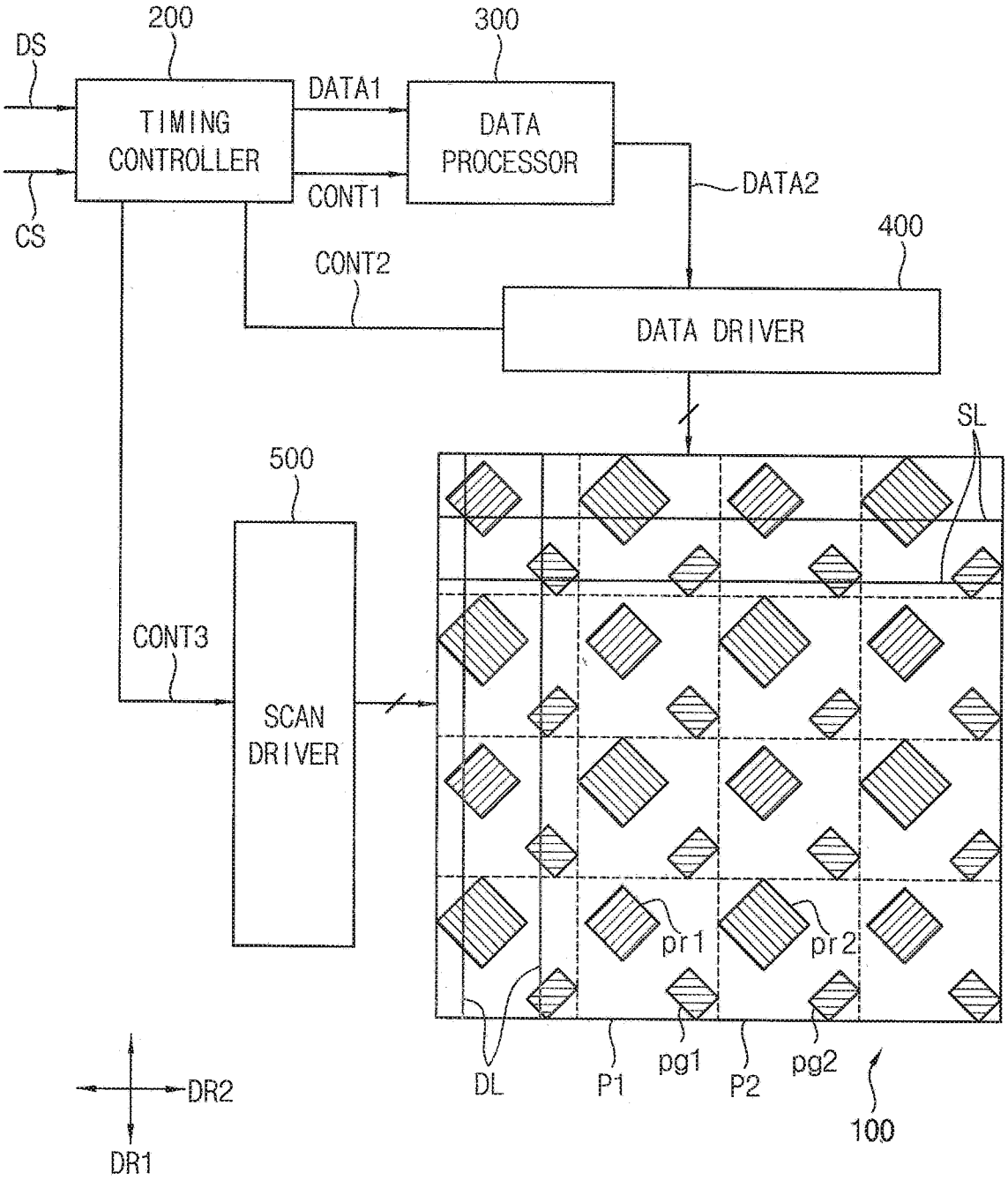
FIG. 1 is a block diagram illustrating a display device according to example embodiments.

FIG. 1 is a block diagram illustrating a display device according to example embodiments.

Referring to FIG. 1, the display device may include a display unit 100, a timing controller 200, a data processor 300, a data driver 400, and a scan driver 500.

The display unit 100 may include a plurality of data lines DL, a plurality of scan lines SL, and a plurality of pixels P1 and P2. The plurality of data lines DL may extend in a first direction DR1 while being arranged along a second direction DR2 crossing the first direction DR1. The plurality of scan lines SL may extend in the second direction DR2 while being arranged along the first direction DR1. The plurality of pixels P1 and P2 may be arranged in various forms (e.g., a matrix form, etc.) including a plurality of pixel rows and a plurality of pixel columns. Each of the plurality of pixels may include a plurality of sub-pixels having a pentile pixel structure.

The pixel column may include a first pixel P1 and a second pixel P2 alternately arranged along the first direction DR1, and the pixel row may include the first pixel P1 and the second pixel P2 alternately arranged along the second direction DR2.

The first pixel P1 may include a first sub-pixel pr1 and a second sub-pixel pg1, and the second pixel P2 may include a third sub-pixel pr2 and a fourth sub-pixel pg2.

The first sub-pixel pr1 may display a first color and have a diamond shape, and the second sub-pixel pg1 may display a second color and have a rectangular shape. The third sub-pixel pr2 may display a third color and have a diamond shape, and the fourth sub-pixel pg2 may display the second color and have a rectangular shape. For example, the first color may be red, the second color may be green, and the third color may be blue. Therefore, the display unit 100 may display full white by a color combination of at least the first and second pixels P1 and P2.

The timing controller 200 may receive an image signal DS and a control signal CS from an external device. The image signal DS may include red, green, and blue grayscale data. The control signal CS may include a horizontal synchronization signal, a vertical synchronization signal, a main clock signal, and the like.

The timing controller 200 may provide red, green, and blue grayscale data DATA1 to the data processor 300. The timing controller 200 may generate a first control signal CONT1 for controlling the driving of the data processor 300 and may provide the first control signal CONT1 to the data processor 300. The timing controller 200 may generate a second control signal CONT2 for controlling the driving of the data driver 400 and may provide the second control signal CONT2 to the data driver 400. The timing controller 200 may generate a third control signal CONT3 for controlling the driving of the scan driver 500 and may provide the third control signal CONT3 to the scan driver 500.

The data processor 300 may convert the red, green and blue grayscale data DATA1 into red and green grayscale data or blue and green grayscale data corresponding to the first and second pixels P1 and P2 of the display unit 100 and may provide the red and green grayscale data or the blue and green grayscale data DATA2 to the data driver 400.

The data processor 300 may convert the red, green, and blue grayscale data DATA1 into red, green, and blue luminance data by applying an input gamma, distribute the red, green, and blue luminance data to red and green luminance data or blue and green luminance data corresponding to the pentile pixel structure of the display unit 100 by applying the sub-pixel rendering (SPR) and may convert the red and green luminance data or the blue and green luminance data into red and green grayscale data or blue and green grayscale data DATA2 by applying an output gamma. A driving method of the data processor 300 according to example embodiments will be described below.

The data driver 400 may convert the red and green grayscale data or the blue and green grayscale data DATA2 into a data voltage by using a gamma voltage, and may provide the data voltage to the data line DL of the display unit 100.

The scan driver 500 may generate a scan signal including a scan on voltage and a scan off voltage and may provide the scan signal to the scan line SL.

Figure 2:
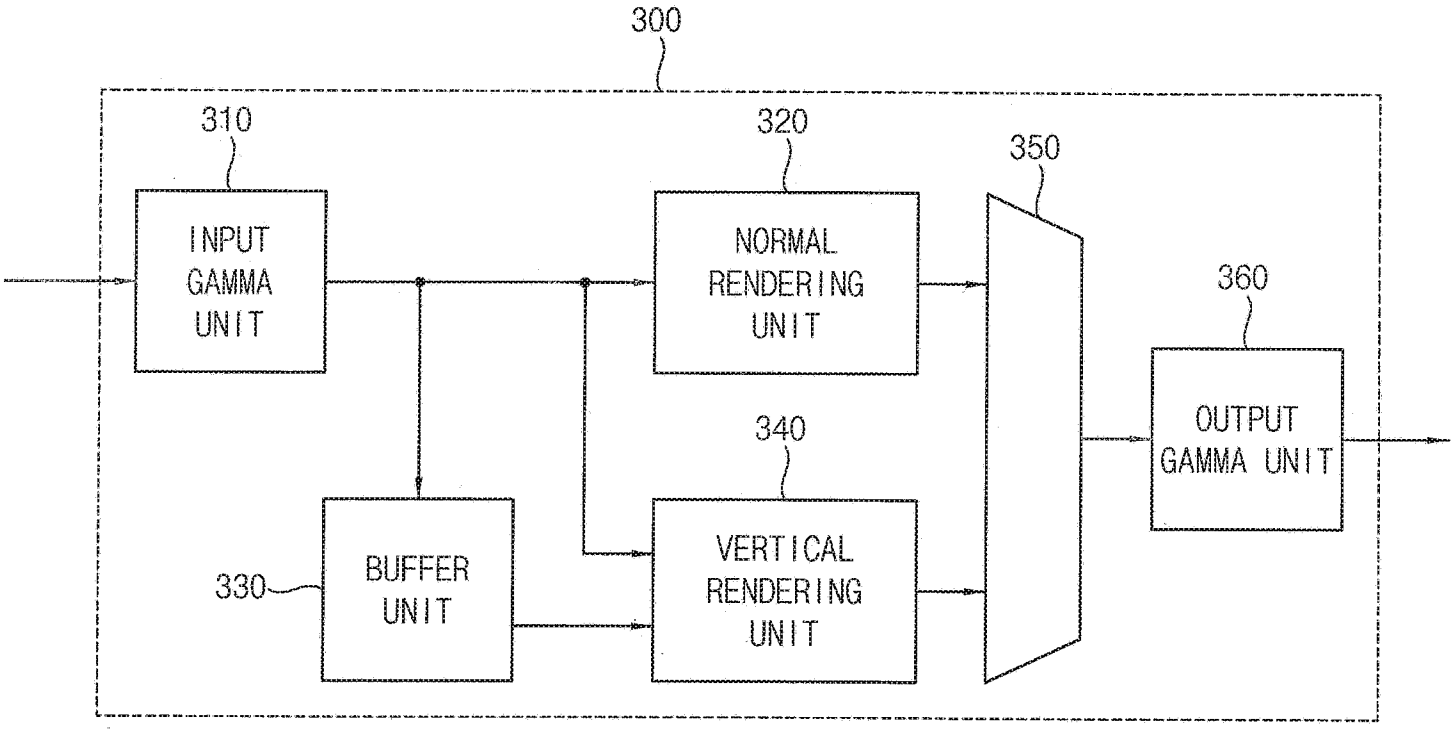
FIG. 2 is a block diagram for describing a data processor according to example embodiments.

FIG. 2 is a block diagram illustrating a data processor according to example embodiments.

Referring to FIG. 2, the data processor 300 may include an input gamma unit 310, a normal rendering unit 320, a buffer unit 330, a vertical rendering unit 340, an output selection unit 350, and an output gamma unit 360.

The input gamma unit 310 may convert red, green, and blue grayscale data which are input data, into red, green, and blue luminance data by applying an input gamma.

The normal rendering unit 320 may distribute the red, green, and blue luminance data into red and green luminance data or blue and green luminance data.

The buffer unit 330 may store red, green, and blue luminance data, which correspond to a pixel included in a vertical edge area of the display unit 100, provided from the input gamma unit 310.

The vertical rendering unit 340 may distribute the data to the red and green luminance data or the blue and green luminance data corresponding to a pixel included in the vertical edge region by using the red, green, and blue luminance data stored in the buffer unit 330.

The output selection unit 350 may output red and green luminance data or blue and green luminance data provided from the normal rendering unit 320 for pixels included in the remaining area of the display unit 100 except for the vertical edge region and may output red and green luminance data or blue and green luminance data provided from the vertical rendering unit 340 for pixels included in the vertical edge region under the control of the timing controller 200.

The output gamma unit 360 may convert the red and green luminance data or the blue and green luminance data provided from the output selection unit 350 into red and green grayscale data or blue and green grayscale data by applying an inverse gamma to output the red and green grayscale data or blue and green gray scale data.

Figure 3A:
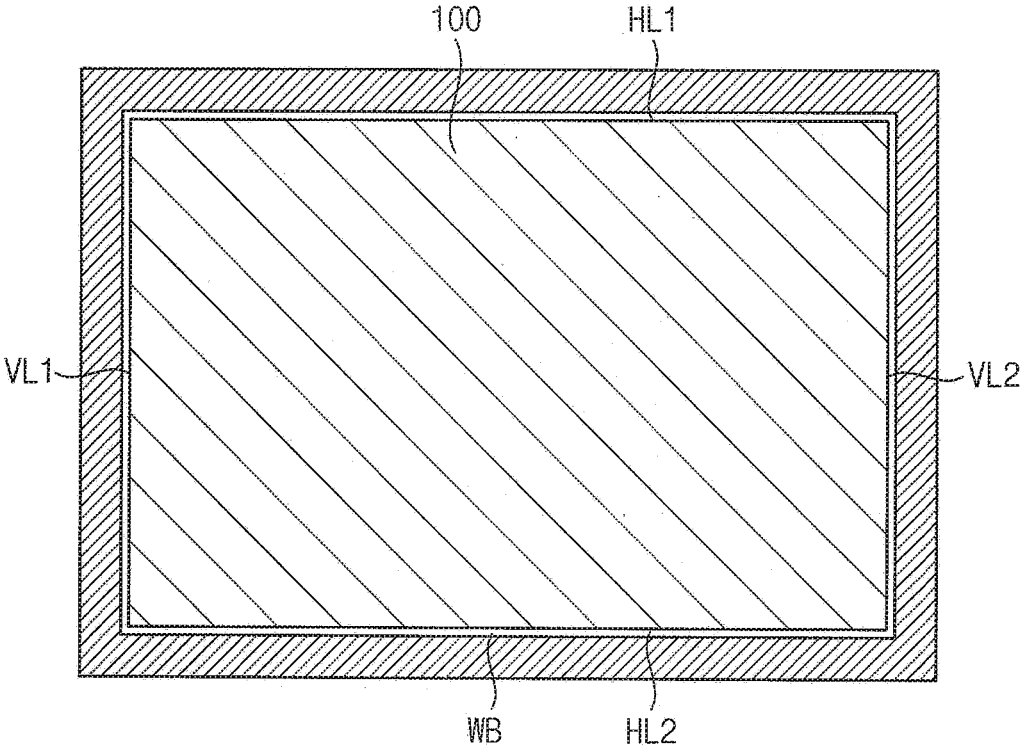
FIGS. 3A and 3B are conceptual diagrams illustrating a white solid line box displayed on a display unit according to example embodiments.
Figure 3B:
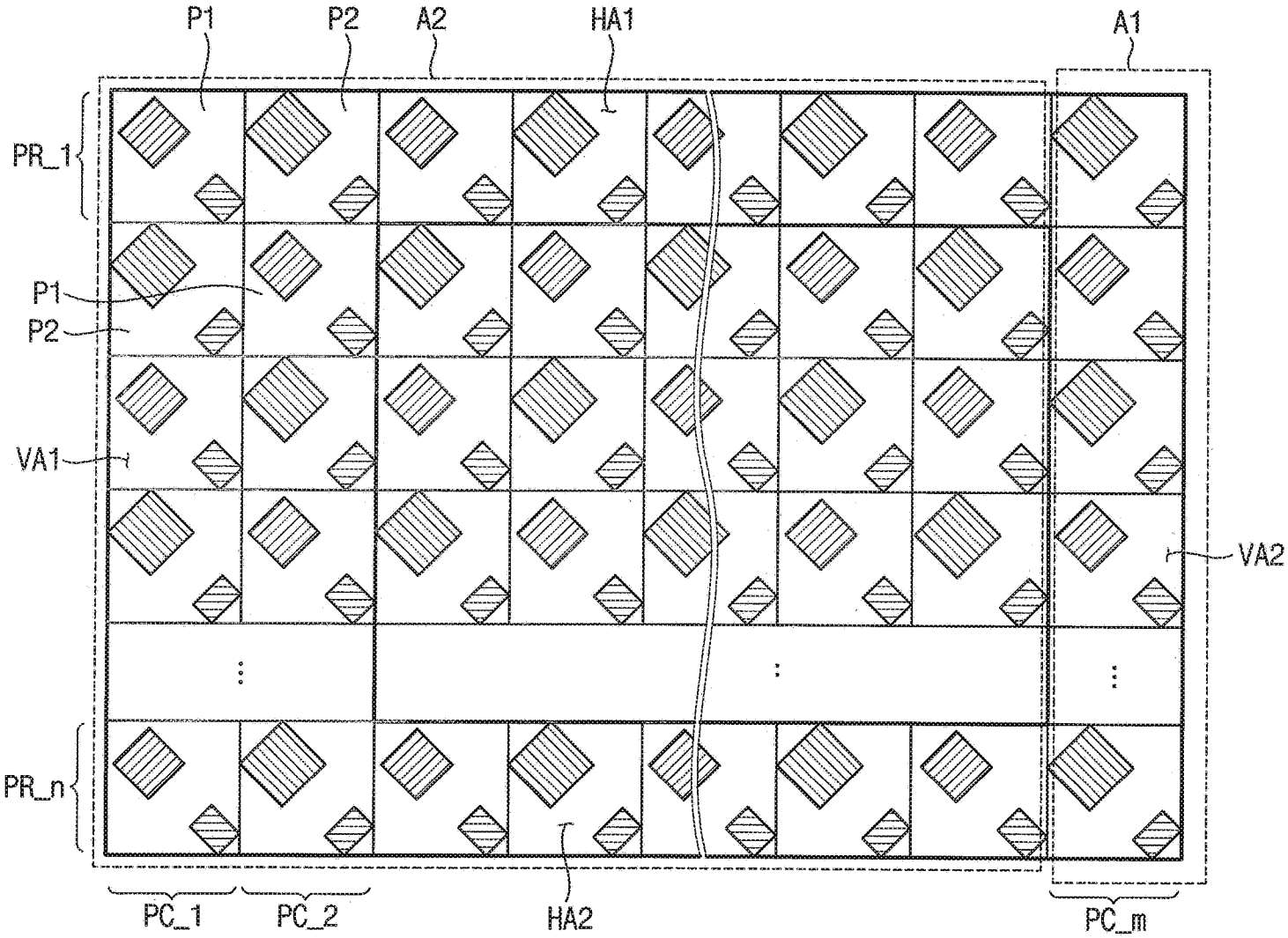

FIGS. 3A and 3B are conceptual diagrams illustrating a white solid line box displayed on a display unit according to example embodiments.

Referring to FIGS. 3A and 3B, the white solid line box WB may be displayed along an outer portion of the display unit 100, and an inside of the white solid line box WB (e.g., an area surrounded by the white solid line box WB) may display black.

A first horizontal line HL1 of the white solid line box WB may be displayed on a first horizontal line area HA1 of the display unit 100, a second horizontal line HL2 of the white solid line box WB may be displayed on a second horizontal line area HA2 of the display unit 100, a first vertical line VL1 of the white solid line box WB may be displayed on a first vertical line area VA1 of the display unit 100, and a second vertical line VL2 of the white solid line box WB may be displayed on a second vertical line area VA2 of the display unit 100.

The first horizontal line area HA1 may include a first pixel row PR_1, and the second horizontal line area HA2 may include a last pixel row PR_n. The first vertical line area VA1 may include first and second pixel columns PC_1 and PC_2, and the second vertical line area VA2 may include a last pixel column PC_m.

The display unit 100 may be divided into a first area A1 corresponding to the second vertical line area VA2 and a second area A2 corresponding to the remaining area of the display unit 100 (which excludes the first area A1). In an example embodiment, the sub-pixel rendering methods for the first area A1 and the second area A2 of the display unit 100 may be different from each other.

Hereinafter, when the white solid line box WB is displayed on the display unit 100, a driving method of the data processor 300 will be described.

Figure 4:
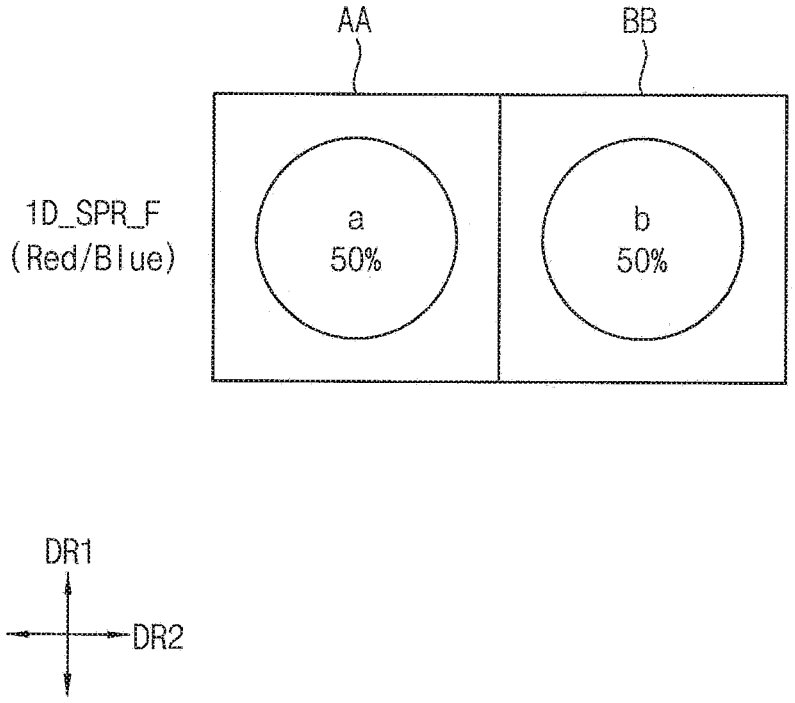
FIG. 4 is a conceptual diagram for describing a one-dimensional sub-pixel rendering filter applied to a normal rendering unit shown in FIG. 2.

FIG. 4 is a conceptual diagram for describing a one-dimensional sub-pixel rendering filter applied to a normal rendering unit shown in FIG. 2.

Referring to FIG. 4, a one-dimensional sub-pixel rendering filter 1D_SPR_F may distribute red luminance data and blue luminance data to pixels arranged in the horizontal direction DR2.

The one-dimensional sub-pixel rendering filter 1D_SPR_F may be a 2×1 filter. In the one-dimensional sub-pixel rendering filter 1D_SPR_F, a reference pixel AA may have a first filter coefficient (a), and a neighboring pixel BB adjacent to the reference pixel AA in the horizontal direction DR2 may have a second filter coefficient (b). For example, the first filter coefficient (a) may be 50%, and the second filter coefficient (b) may be 50%.

Meanwhile, the rendering filter may not be applied to the green luminance data of the pixels arranged in the horizontal direction DR2. In this case, 100% of green luminance data of the pixels may be distributed.

Figure 5:
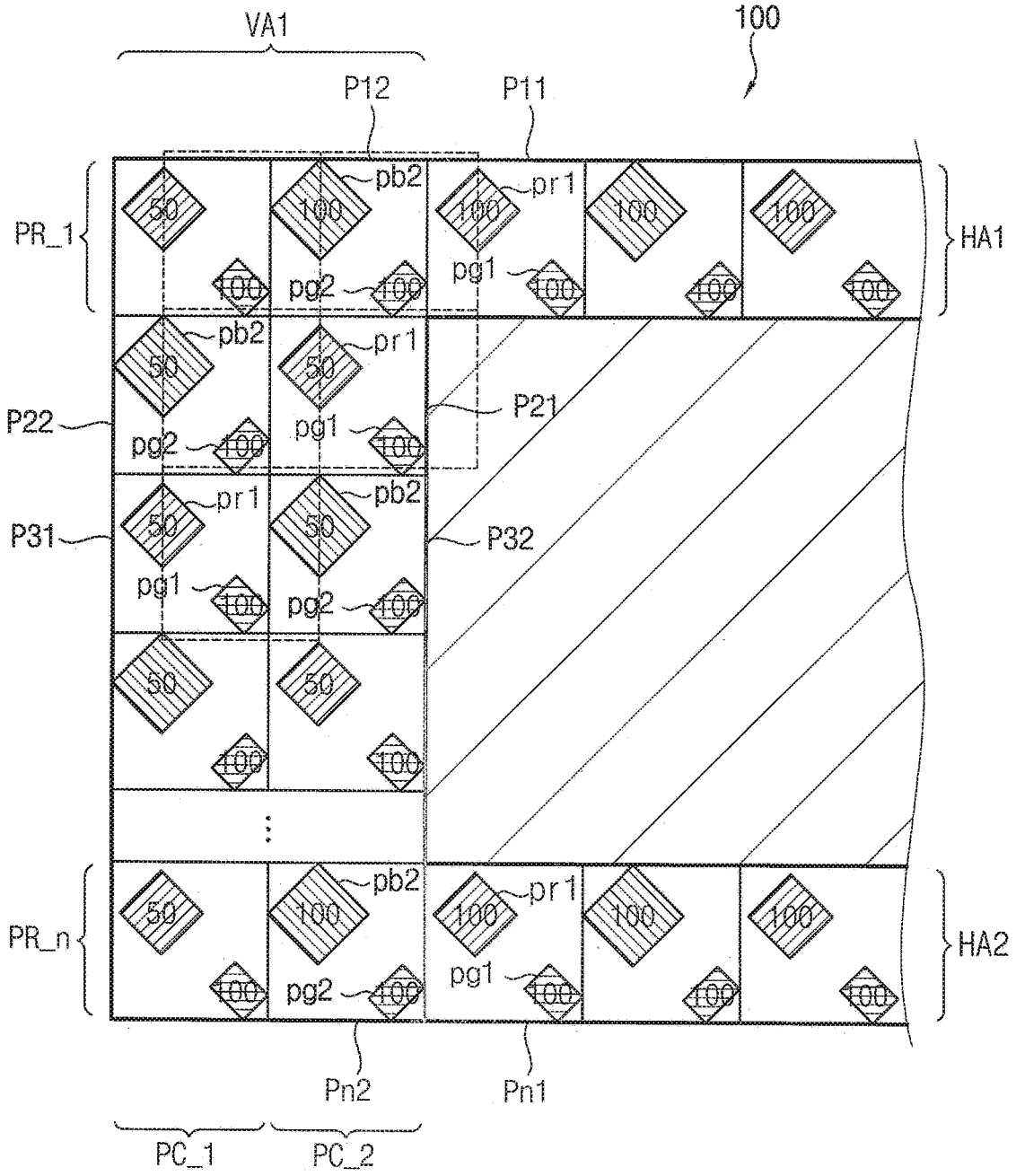
FIG. 5 is a conceptual diagram for describing a rendering method of a normal rendering unit shown in FIG. 2.

FIG. 5 is a conceptual diagram for describing a rendering method of the normal rendering unit shown in FIG. 2.

Referring to FIGS. 4 and 5, the first horizontal line of the white solid line box WB may be displayed by first and second pixels P11 and P12 included in a first pixel row PR_1 corresponding to the first horizontal line area HA1.

The normal rendering unit according to example embodiments may distribute red and green luminance data of the first pixel included in the first pixel row PR_1 and blue and green luminance data of the second pixel included in the first pixel row PR_1 by using the one-dimensional sub-pixel rendering filter 1D_SPR_F.

For example, the one-dimensional sub-pixel rendering filter 1D_SPR_F may be a 2×1 filter. In the one-dimensional sub-pixel rendering filter 1D_SPR_F, the reference pixel AA may have a first filter coefficient (a), and the neighboring pixel BB adjacent to the reference pixel AA in the horizontal direction DR2 may have a second filter coefficient (b). For example, the first filter coefficient (a) may be 50%, and the second filter coefficient (b) may be 50%.

As the one-dimensional sub-pixel rendering filter 1D_SPR_F is applied, the first pixel P11 of the first pixel row PR_1 may have 100% of first red luminance data pr1 in which 50% of the red luminance data of the first pixel P11 and 50% of the red luminance data of the neighboring pixel are distributed and first green luminance data pg1 in which the green luminance data of the first pixel P11 is distributed at 100%. The second pixel P12 of the first pixel row PR_1 may have 100% of second blue luminance data pb2 in which 50% of the blue luminance data of the second pixel P12 and 50% of the blue luminance data of the neighboring pixel are distributed and second green luminance data pg2 in which the green luminance data of the second pixel P12 is distributed at 100%.

In this manner, the first horizontal line HL1 of the white solid line box WB shown in FIG. 3A may be displayed as white by the first and second pixels P11 and P12 of the first pixel row PR_1.

Then, the second horizontal line of the white solid line box WB may be displayed by the first and second pixels Pn1 and Pn2 included in an $n^{th}$ pixel row PR_n corresponding to the second horizontal line area HA2.

The normal rendering unit according to example embodiments may distribute the red and green luminance data of the first pixel included in the $n^{th}$ pixel row PR_n and the blue and green luminance data of the second pixel included in the $n^{th}$ pixel row PR_n by using the one-dimensional sub-pixel rendering filter 1D_SPR_F.

For example, a first pixel Pn1 of the $n^{th}$ pixel row PR_n may have 100% of the first red luminance data pr1 in which 50% of the red luminance data of the first pixel Pn1 and 50% of the red luminance data of the neighboring pixel are distributed and the first green luminance data pg1 in which the green luminance data of the first pixel Pn1 is distributed at 100%. A second pixel Pn2 of the $n^{th}$ pixel row PR_n may have 100% of the second blue luminance data pb2 in which 50% of the blue luminance data of the second pixel Pn2 and 50% of the blue luminance data of the neighboring pixel are distributed and the second green luminance data pg2 in which the green luminance data of the second pixel Pn2 is distributed at 100%.

In this manner, the second horizontal line HL2 of the white solid line box WB shown in FIG. 3A may be displayed as white by the first and second pixels Pn1 and Pn2 of the $n^{th}$ pixel row PR_n.

Then, the first vertical line of the white solid line box may be displayed by first and second pixels P21, P22, P31, and P32 included in a first pixel column PC_1 and a second pixel column PC_2 corresponding to the first vertical line area VA1.

The normal rendering unit according to example embodiments may distribute the red and green luminance data of the first pixel included in the first and second pixel columns PC_1 and PC_2 and the blue and green luminance data of the second pixel included in the first and second pixel columns PC_1 and PC_2 by using the one-dimensional sub-pixel rendering filter 1D_SPR_F.

For example, because a first pixel P31 of the first pixel column PC_1 has no neighboring pixels, the first pixel P31 of the first pixel column PC_1 may have the first red luminance data pr1 in which only the red luminance data of the first pixel P31 is distributed at 50% and the first green luminance data pg1 in which 100% of the green luminance data of the first pixel P31 is distributed. In addition, because a second pixel P22 of the first pixel column PC_1 has no neighboring pixels, the second pixel P22 may have the blue luminance data pb2 in which only the blue luminance data of the second pixel P22 is distributed at 50% and the second green luminance data pg2 in which the green luminance data of the second pixel P22 is distributed at 100%.

In addition, because the neighboring pixel of the first pixel P21 displays black, the first pixel P21 of the second pixel column PC_2 may have the first red luminance data pr1 in which only the red luminance data of the first pixel P21 is distributed at 50% and the first green luminance data pg1 in which the green luminance data pg1 of the first pixel P21 is distributed at 100%. Because the neighboring pixel of the second pixel P32 displays black, the second pixel P32 of the second pixel column PC_2 may have the second blue luminance data pb2 in which only the blue luminance data of the second pixel P32 is distributed at 50% and the second green luminance data pg2 in which the green luminance data of the second pixel P32 is distributed at 100%.

In this manner, the first vertical line VL1 of the white solid line box shown in FIG. 3A may be displayed as white by the first and second pixels P21, P22, P31, and P32 included in the first pixel column PC_1 and the second pixel column PC_2.

Figure 6:
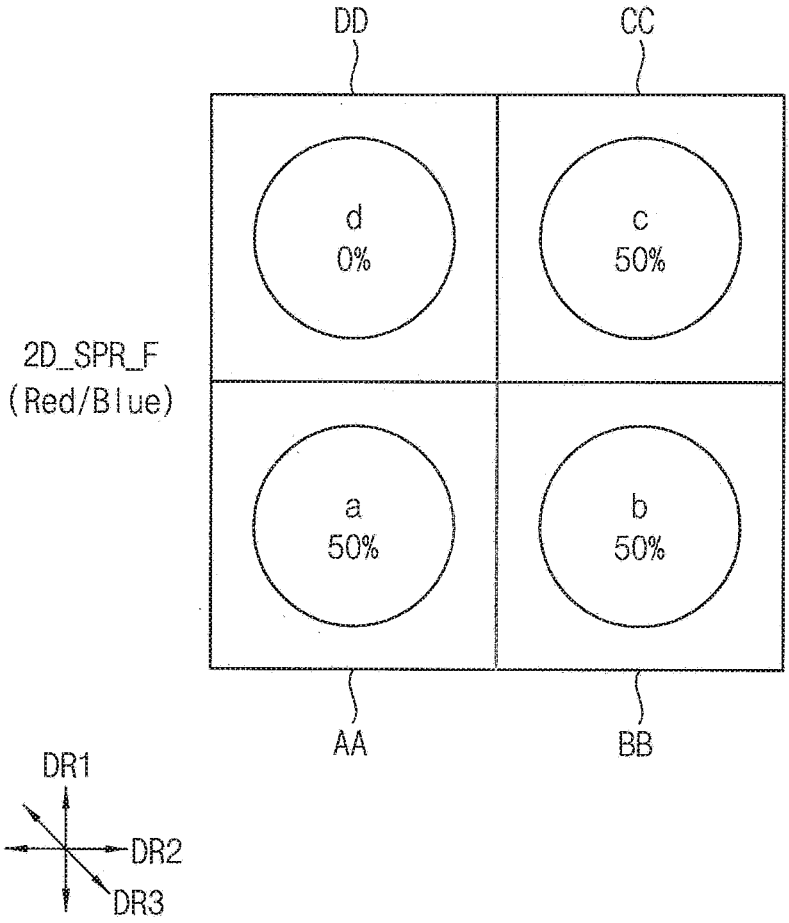
FIG. 6 is a conceptual diagram for describing a two-dimensional sub-pixel rendering filter applied to a vertical rendering unit shown in FIG. 2.

FIG. 6 is a conceptual diagram for describing a two-dimensional sub-pixel rendering filter applied to a vertical rendering unit shown in FIG. 2.

Referring to FIG. 6, for example, the two-dimensional sub-pixel rendering filter 2D_SPR_F may be a 2×2 rendering filter.

The two-dimensional sub-pixel rendering filter 2D_SPR_F may distribute the red luminance data and the blue luminance data of pixels arranged in the 2×2 configuration.

For example, in the two-dimensional sub-pixel rendering filter 2D_SPR_F, a reference pixel BB may have a first filter coefficient (b), a first neighboring pixel AA adjacent to the reference pixel BB in the horizontal direction DR2 may have a second filter coefficient (a), a second neighboring pixel CC adjacent to the reference pixel BB in the vertical direction DR1 may have a third filter coefficient (c), and a third neighboring pixel DD adjacent to the reference pixel BB in a diagonal direction DR3 may have a fourth filter coefficient (d). The first filter coefficient (b) may be 50%, the second filter coefficient (a) may be 50%, the third filter coefficient (c) may be 50%, and the fourth filter coefficient (d) may be 0%.

The sum of the filter coefficients filter_sum of the two-dimensional sub-pixel rendering filter 2D_SPR_F may be greater than 1. If the sum of the filter coefficients filter_sum is greater than or equal to 1, the sum of the filter coefficients filter_sum is determined as 1, and if the sum of the filter coefficients filter_sum is less than 1, the sum of the filter coefficients is determined as the sum of the filter coefficients filter_sum.

The sum of the filter coefficients filter_sum of the two-dimensional sub-pixel rendering filter 2D_SPR_F may be defined as shown in [Equation 1] below.

$$\text{filter_sum}=d1\times a+d2\times b+d3\times c+d4\times d, \quad \text{[Equation 1]}$$

wherein $0 \le di \le 1$ (i is a natural number)

Meanwhile, the rendering filter may not be applied to the green luminance data of the pixels arranged in the 2×2 configuration. In this case, the green luminance data of the pixels may be distributed at 100%.

Figure 7:
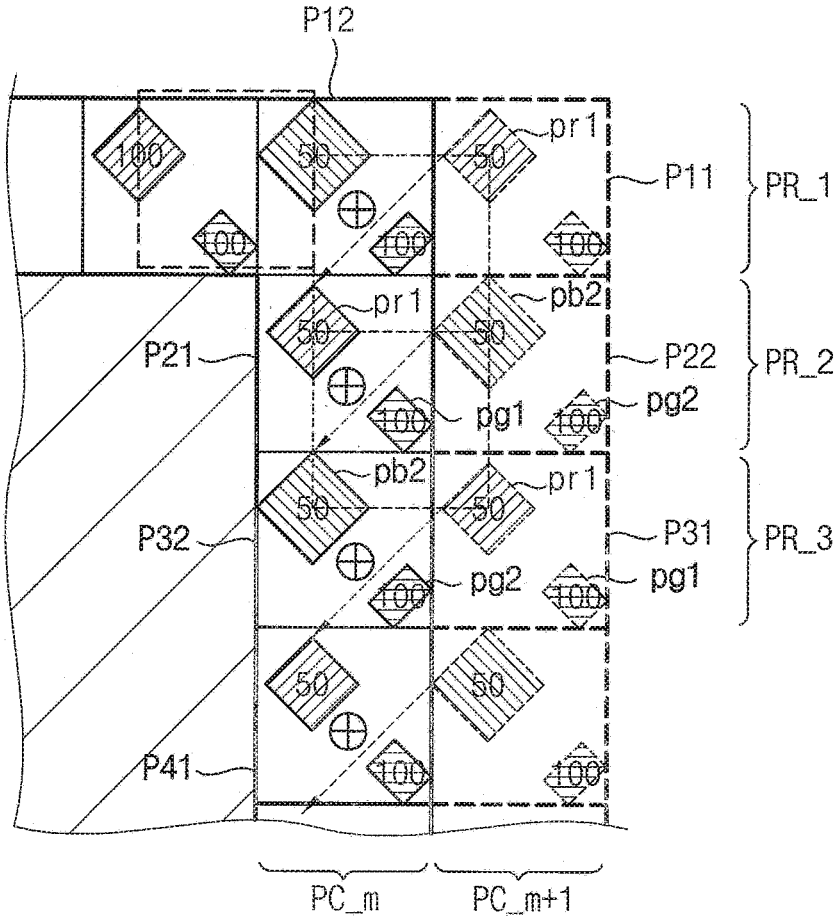
FIGS. 7 and 8 are conceptual diagrams for describing a rendering method of a vertical rendering unit shown in FIG. 2.
Figure 8:
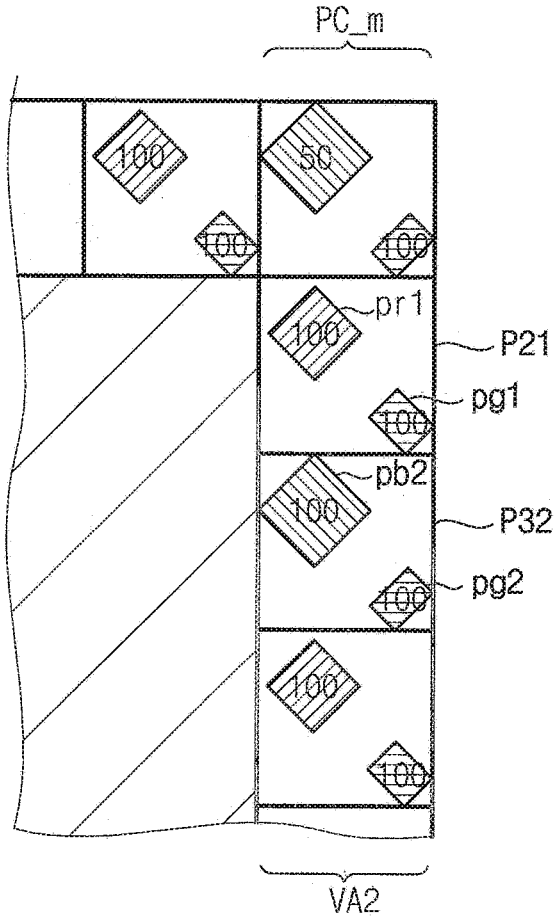

FIGS. 7 and 8 are conceptual diagrams for describing a rendering method of a vertical rendering unit shown in FIG. 2.

Referring to FIGS. 6 and 7, the second vertical line of the white solid line box WB may be displayed by first and second pixels P12, P21, and P32 included in an $m^{th}$ pixel column PC_m which is the last pixel column corresponding to the second vertical line area VA2.

In an example embodiment, the buffer unit may store red, green and blue luminance data corresponding to pixels included in the last $m^{th}$ pixel column PC_m corresponding to the second vertical line.

The vertical rendering unit may distribute data to the red and green luminance data or blue and green luminance data of the pixels included in the $m^{th}$ pixel column PC_m by using red, green, and blue luminance data of pixels corresponding to the $m^{th}$ pixel column PC_m stored in the buffer unit as the red, green, and blue luminance data corresponding to the pixels of an $(m+1)^{th}$ pixel column PC_m+1 which is an absent pixel column that is not physically present in the display unit 100.

First, the vertical rendering unit may distribute the red and green luminance data or blue and green luminance data for the $m^{th}$ pixel column PC_m and the $(m+1)^{th}$ pixel column PC_m+1 by using the two-dimensional sub-pixel rendering filter 2D_SPR_F.

Referring to first and second pixel rows PR_1 and PR_2 of the $m^{th}$ and $(m+1)^{th}$ pixel columns PC_m and PC_m+1, the blue luminance data of the second pixel P12 may be distributed at 0% in the second pixel P12 of the $m^{th}$ pixel column PC_1. Meanwhile, the second pixel P12 may have the second blue luminance data pb2 in which the blue luminance data of the second pixel P12 is distributed at 50% by the one-dimensional sub-pixel rendering filter 1D_SPR_F of the normal rendering unit. The first pixel P11 of the $m^{th}$ pixel column PC_1 may have the first red luminance data pr1 in which the red luminance data of the first pixel P11 is distributed at 50% and the first green luminance data pg1 in which the green luminance data of the first pixel P11 is distributed at 100%.

The first pixel P21 of the $(m+1)^{th}$ pixel column PC_m+1 may have the first red luminance data pr1 in which the red luminance data of the first pixel P21 is distributed at 50% and the first green luminance data pg1 in which the green luminance data of the first pixel P21 is distributed at 100%. The second pixel P22 of the $(m+1)^{th}$ pixel column PC_m+1 may have the second blue luminance data pb2 in which the blue luminance data of the second pixel P22 is distributed at 50% and the second green luminance data pg2 in which the green luminance data of the second pixel P22 is distributed at 100%.

Next, referring to second and third pixel rows PR_2 and PR_3 of the $m^{th}$ and $(m+1)^{th}$ pixel columns PC_m and PC_m+1, the red luminance data pr1 of the first pixel P21 may be distributed at 0% in the first pixel P21 of the $m^{th}$ pixel column PC_1. Meanwhile, the first pixel P21 may have the first red luminance data pr1 in which the red luminance data of the first pixel P21 is distributed at 50% in the previous two-dimensional rendering operation. The second pixel P22 of the $m^{th}$ pixel column PC_1 may have the second blue luminance data pb2 in which the blue luminance data of the second pixel P22 is distributed at 50% and the second green luminance data pg2 in which the green luminance data of the second pixel P22 is distributed at 100%.

The second pixel P32 of the $(m+1)^{th}$ pixel column PC_m+1 may have the second blue luminance data pb2 in which the blue luminance data of the second pixel P32 is distributed at 50% and the second green luminance data pg2 in which the green luminance data of the second pixel P32 is distributed at 100%. The first pixel P31 of the $(m+1)^{th}$ pixel column PC_m+1 may have the first red luminance data pr1 in which the red luminance data of the first pixel P31 is distributed at 50% and the first green luminance data pg1 in which the green luminance data of the first pixel P31 is distributed at 100%.

In this manner, the red and green luminance data or blue and green luminance corresponding to the $m^{th}$ pixel column PC_m and the $(m+1)^{th}$ pixel column PC_m+1 may be distributed by using the two-dimensional sub-pixel rendering filter 2D_SPR_F.

Then, the vertical rendering unit may add up the 50% first red luminance data pr1 and the second blue luminance data pb2 distributed in the first and second pixels P11, P22, and P31 corresponding to the $(m+1)^{th}$ pixel column PC_m+1 to the 50% first red luminance data pr1 and the second blue luminance data pb2 distributed in the first and second pixels P21, P32, and P41 corresponding to the $m^{th}$ pixel column PC_m.

Referring to FIGS. 7 and 8, the 50% first red luminance data pr1 distributed in the first pixel P11 included in the first pixel row PR_1 of the $(m+1)^{th}$ pixel column PC_m+1 may be added up to the 50% first red luminance data pr1 distributed in the first pixel P21 included in the second pixel row PR_2 of the $m^{th}$ pixel column PC_m, so that the first pixel P21 included in the second pixel row PR_2 of the $m^{th}$ pixel column PC_m may have the first red luminance data pr1 of 100%.

In addition, the 50% second blue luminance data pb2 distributed in the second pixel P22 included in the second pixel row PR_2 of the $(m+1)^{th}$ pixel column PC_m+1 may be added up to the 50% second blue luminance data pb2 distributed in the second pixel P32 included in the third pixel row PR_3 of the $m^{th}$ pixel column PC_m, so that the second pixel P32 included in the third pixel row PR_3 of the $m^{th}$ pixel column PC_m may have the second blue luminance data pb2 of 100%.

In this manner, the red and blue luminance data distributed in the first and second pixels included in the $m^{th}$ pixel column PC_m may be added up to the red and blue luminance data distributed in the first and second pixels included in the $(m+1)^{th}$ pixel column PC_m+1, so that the second vertical line VL2 of the white solid line box WB shown in FIG. 3A may be displayed as white by the first and second pixels P21, P32, and P41 included in the $m^{th}$ pixel column PC_m.

According to the above embodiment, when the white solid line box WB is displayed on the outer portion of the display unit, the luminance distribution defect caused by the physical pixel shortage can be prevented at the vertical line portion of the white solid line box WB.

Figure 9:
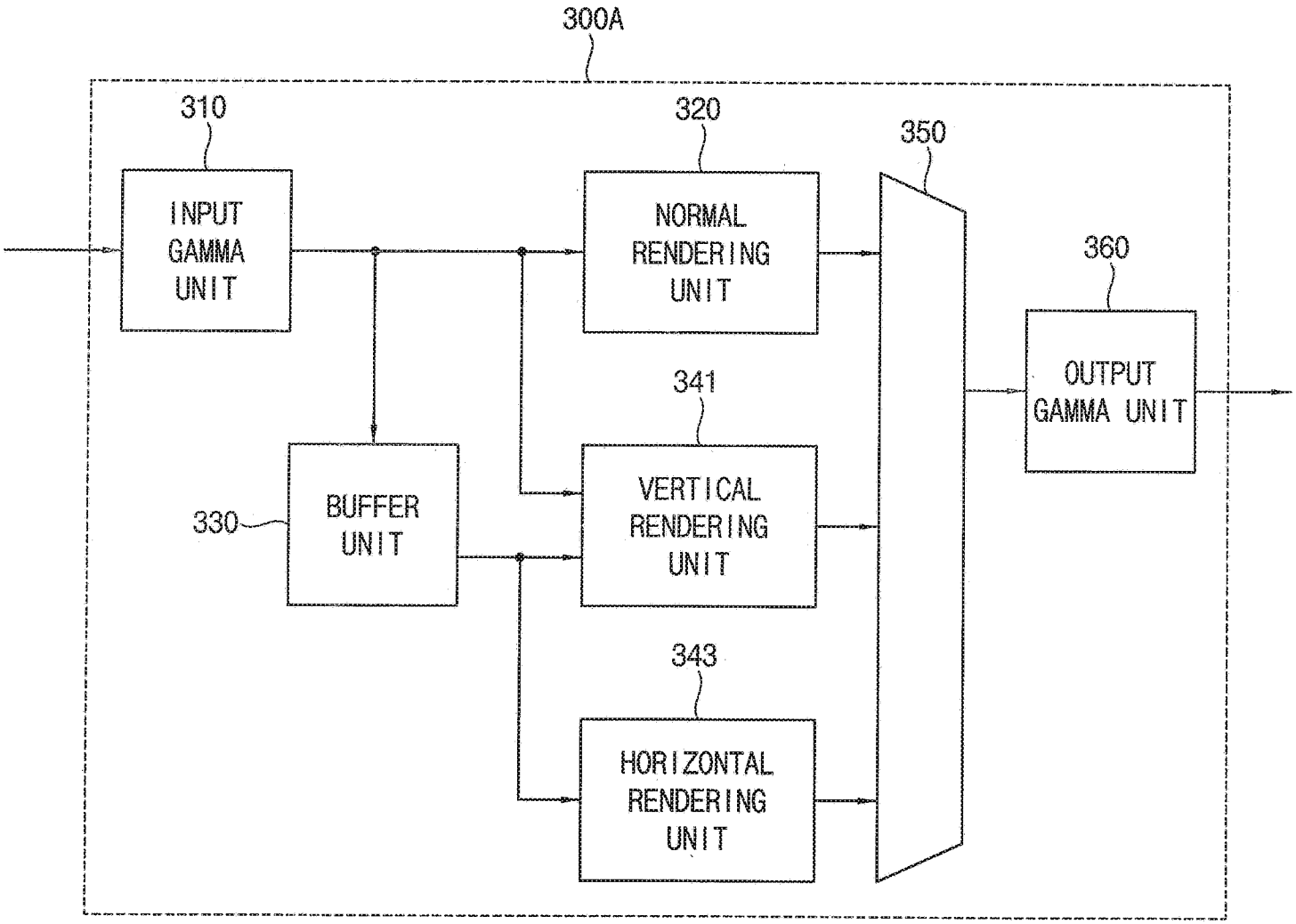
FIG. 9 is a block diagram for describing a data processor according to example embodiments.

FIG. 9 is a block diagram for describing a data processor according to example embodiments.

Referring to FIG. 9, the data processor 300A may include an input gamma unit 310, a normal rendering unit 320, a buffer unit 330, a vertical rendering unit 341, a horizontal rendering unit 343, an output selection unit 350, and an output gamma unit 360.

The input gamma unit 310 may convert red, green, and blue grayscale data which are input data, into red, green, and blue luminance data by applying an input gamma.

The normal rendering unit 320 may distribute the red, green, and blue luminance data into the red and green luminance data or blue and green luminance data.

The buffer unit 330 may store the red, green, and blue luminance data corresponding to pixels included in the vertical and horizontal edge areas of the display unit 100.

The vertical rendering unit 341 may distribute the data to the red and green luminance data or the blue and green luminance data corresponding to a pixel included in the vertical edge region by using the red, green, and blue luminance data stored in the buffer unit 330 in correspondence with the vertical edge region.

The horizontal rendering unit 343 may distribute the data to the red and green luminance data or the blue and green luminance data corresponding to a pixel included in the horizontal edge region by using the red, green, and blue luminance data stored in the buffer unit 330 in correspondence with the horizontal edge region.

The output selection unit 350 may output red and green luminance data or blue and green luminance data provided from the normal rendering unit 320 for pixels included in the remaining area of the display unit 100 except for the vertical edge region and the horizontal edge region, may output red and green luminance data or blue and green luminance data provided from the vertical rendering unit 343 for pixels included in the vertical edge region, and may output red and green luminance data or blue and green luminance data provided from the vertical rendering unit 343 for pixels included in the horizontal edge region under the control of the timing controller 200.

The output gamma unit 360 may convert the red and green luminance data or the blue and green luminance data provided from the output selection unit 350 into red and green grayscale data or blue and green grayscale data by applying an inverse gamma to output the red and green grayscale data or blue and green gray scale data.

Figure 10:
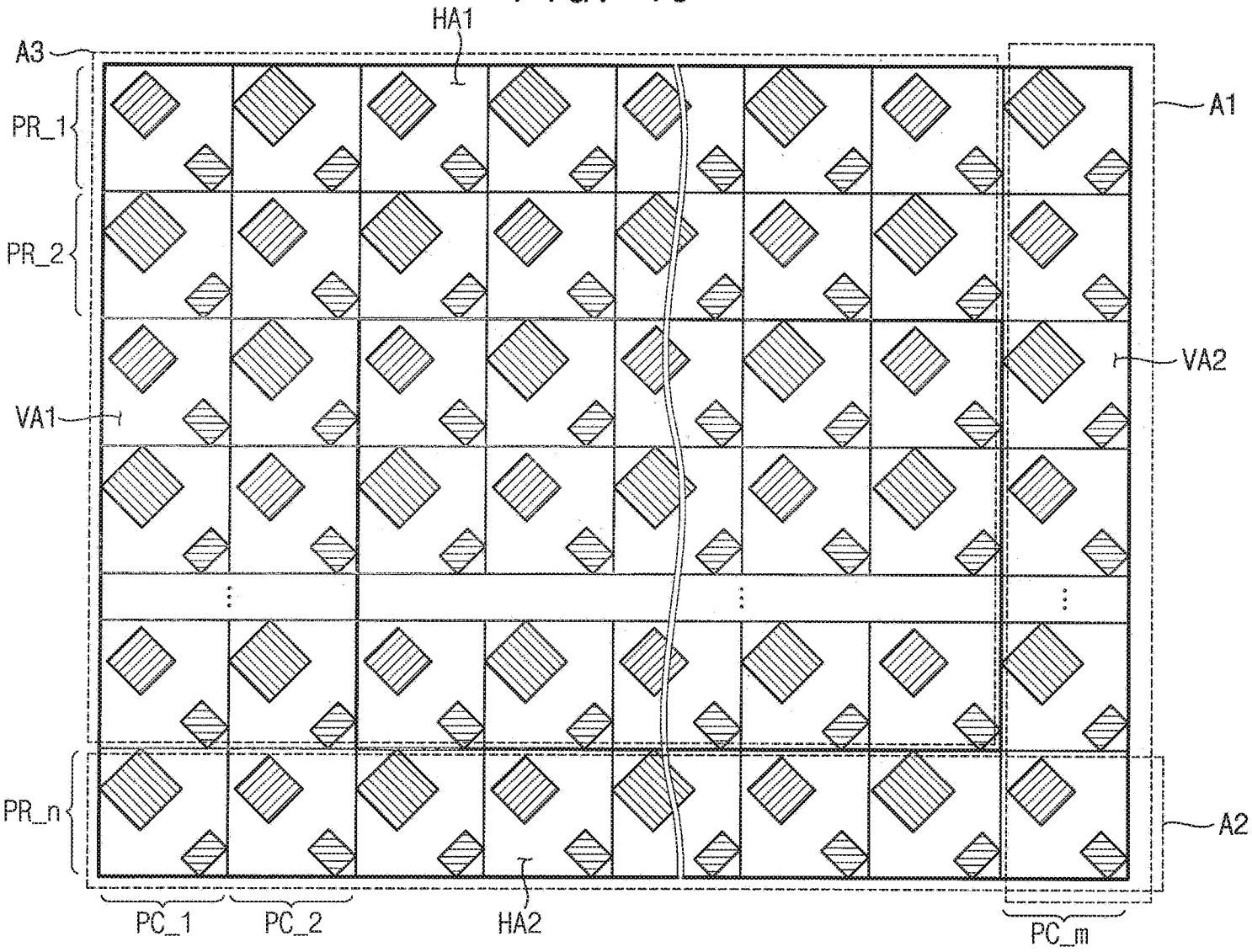
FIG. 10 is a conceptual diagram illustrating a white box displayed on a display unit according to example embodiments.

FIG. 10 is a conceptual diagram illustrating a white box displayed on a display unit according to example embodiments.

Referring to FIGS. 3A and 10, the white solid line box WB may be displayed along the outer portion of the display unit 100, and an inside of the white solid line box WB (e.g., an area surrounded by the white solid line box WB) may display black.

The first horizontal line HL1 of the white solid line box WB may be displayed on the corresponding first horizontal line area HA1 of the display unit 100, the second horizontal line HL2 of the white solid line box WB may be displayed on the second horizontal line area HA2 of the display unit 100, the first vertical line VL1 of the white solid line box WB may be displayed on the first vertical line area VA1 of the display unit 100, and the second vertical line VL2 of the white solid line box WB may be displayed on the second vertical line area VA2 of the display unit 100.

The first horizontal line area HA1 may include first and second pixel rows PR_1 and PR_2, and the second horizontal line area HA2 may include a last pixel row PR_n. The first vertical line area VA1 may include first and second pixel columns PC_1 and PC_2, and the second vertical line area VA2 may include a last pixel column PC_m.

Due to the white solid line box WB, the display unit 100 may include the first area A1 corresponding to the second vertical line area VA2, the second area A2 corresponding to the second horizontal line area HA2, and the third area A3 corresponding to the remaining area of the display unit 100 (which excludes the first and second areas A1 and A2).

Figure 11:
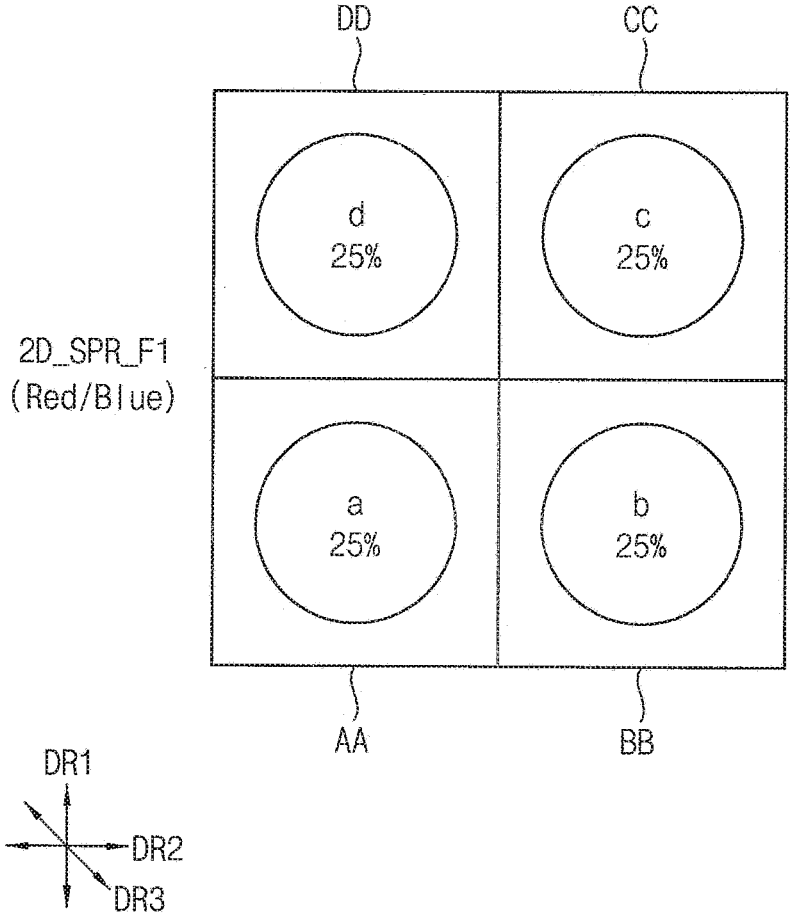
FIG. 11 is a conceptual diagram for describing a two-dimensional sub-pixel rendering filter applied to a normal rendering unit shown in FIG. 9.

FIG. 11 is a conceptual diagram for describing a two-dimensional sub-pixel rendering filter applied to a normal rendering unit shown in FIG. 9.

Referring to FIG. 11, for example, the first two-dimensional sub-pixel rendering filter 2D_SPR_F1 may be a 2×2 rendering filter.

The first two-dimensional sub-pixel rendering filter 2D_SPR_F1 may distribute the red luminance data and blue luminance data for pixels arranged in the 2×2 configuration.

For example, in the first two-dimensional sub-pixel rendering filter 2D_SPR_F1, a reference pixel BB may have a first filter coefficient (b), a first neighboring pixel AA adjacent to the reference pixel BB in the horizontal direction DR2 may have a second filter coefficient (a), a second neighboring pixel CC adjacent to the reference pixel BB in the vertical direction DR1 may have a third filter coefficient (c), and a third neighboring pixel DD adjacent to the reference pixel BB in the diagonal direction DR3 may have a fourth filter coefficient (d). The first filter coefficient (b) may be 25%, the second filter coefficient (a) may be 25%, the third filter coefficient (c) may be 25%, and the fourth filter coefficient (d) may be 25%.

Meanwhile, the rendering filter may not be applied to the green luminance data of the pixels arranged in the 2×2 configuration. In this case, the green luminance data of the pixels may be distributed at 100%.

Figure 12:
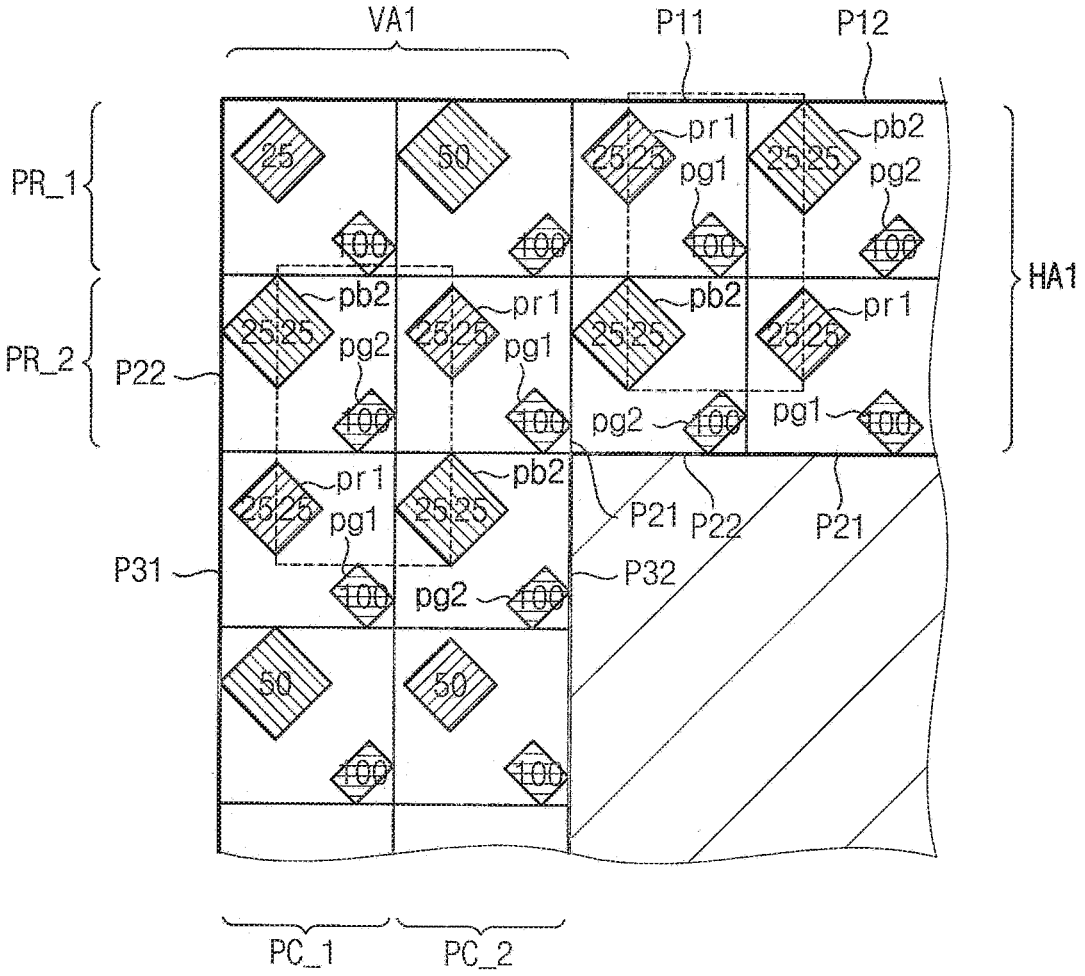
FIG. 12 is a conceptual diagram for describing a rendering method of a normal rendering unit shown in FIG. 9.

FIG. 12 is a conceptual diagram for describing a rendering method of a normal rendering unit shown in FIG. 9.

Referring to FIGS. 11 and 12, the first horizontal line of the white solid line box WB may be displayed by the first and second pixels P11, P12, P21, and P22 included in the first and second pixel rows PR_1 and PR_2 corresponding to the first horizontal line area HA1.

The normal rendering unit may distribute red, green, and blue luminance data of pixels corresponding to the first and second pixel rows PR_1 and PR_2 by applying the first two-dimensional rendering filter 2D_SPR_F1.

For example, the first pixel P11 of the first pixel row PR_1 may have 50% first red luminance data pr1 in which 25% red luminance data of the first pixel P11 is added up to 25% red luminance data of a neighboring pixel and 100% first green luminance data pg1 in which the green luminance data of the first pixel P11 is distributed at 100%. The second pixel P12 of the first pixel row PR_1 may have 50% second blue luminance data pb2 in which 25% blue luminance data of the second pixel P12 is added up to 25% blue luminance data of a neighboring pixel and 100% second green luminance data pg2 in which the green luminance data of the second pixel P12 is distributed at 100%.

The first pixel P21 of the second pixel row PR_2 may have 50% first red luminance data pr1 in which 25% red luminance data of the first pixel P21 is added up to 25% red luminance data of a neighboring pixel and 100% first green luminance data pg1 in which the green luminance data of the first pixel P21 is distributed at 100%. The second pixel P22 of the second pixel row PR_2 may have 50% second blue luminance data pb2 in which 25% blue luminance data of the second pixel P22 is added up to 25% blue luminance data of a neighboring pixel and 100% second green luminance data pg2 in which the green luminance data of the second pixel P22 is distributed at 100%.

In this manner, the first horizontal line HL1 of the white solid line box WB shown in FIG. 3A may be displayed as white by the first and second pixels P11, P12, P21, and P22 of the first and second pixel rows PR_1 and PR_2.

Then, the first vertical line of the white solid line box WB may be displayed by the first and second pixels P21, P22, P31 and P32 included in the first pixel column PC_1 and the second pixel column PC_2 corresponding to the first vertical line area VA1.

The normal rendering unit may distribute red, green, and blue luminance data of the first and second pixel columns PC_1 and PC_2 by applying the first two-dimensional rendering filter 2D_SPR_F1.

For example, the first pixel P21 of the first pixel column PC_1 may have 50% first red luminance data pr1 in which 25% red luminance data of the first pixel P21 is added up to 25% red luminance data of a neighboring pixel and 100% first green luminance data pg1 in which the green luminance data of the first pixel P21 is distributed at 100%. The second pixel P22 of the first pixel column PC_1 may have 50% second blue luminance data pb2 in which 25% blue luminance data of the second pixel P22 is added up to 25% blue luminance data of a neighboring pixel and 100% second green luminance data pg2 in which the green luminance data of the second pixel P22 is distributed at 100%.

The first pixel P21 of the second pixel column PC_2 may have 50% first red luminance data pr1 in which 25% of the red luminance data of the first pixel P21 is added up to 25% red luminance data of the neighboring pixel and 100% first green luminance data pg1 in which the green luminance data of the first pixel P21 is distributed at 100%. The second pixel P32 of the second pixel column PC_2 may have 50% second blue luminance data pb2 in which 25% of the blue luminance data of the second pixel P32 is added up to 25% of the blue luminance data of the neighboring pixel and 100% second green luminance data pg2 in which the green luminance data of the second pixel P32 is distributed at 100%.

In this manner, the first vertical line VL1 of the white solid line box WB shown in FIG. 3A may be displayed as white by the first and second pixels P21, P22, P31, and P32 included in the first and second pixel columns PC_1 and PC_2.

Figure 13:
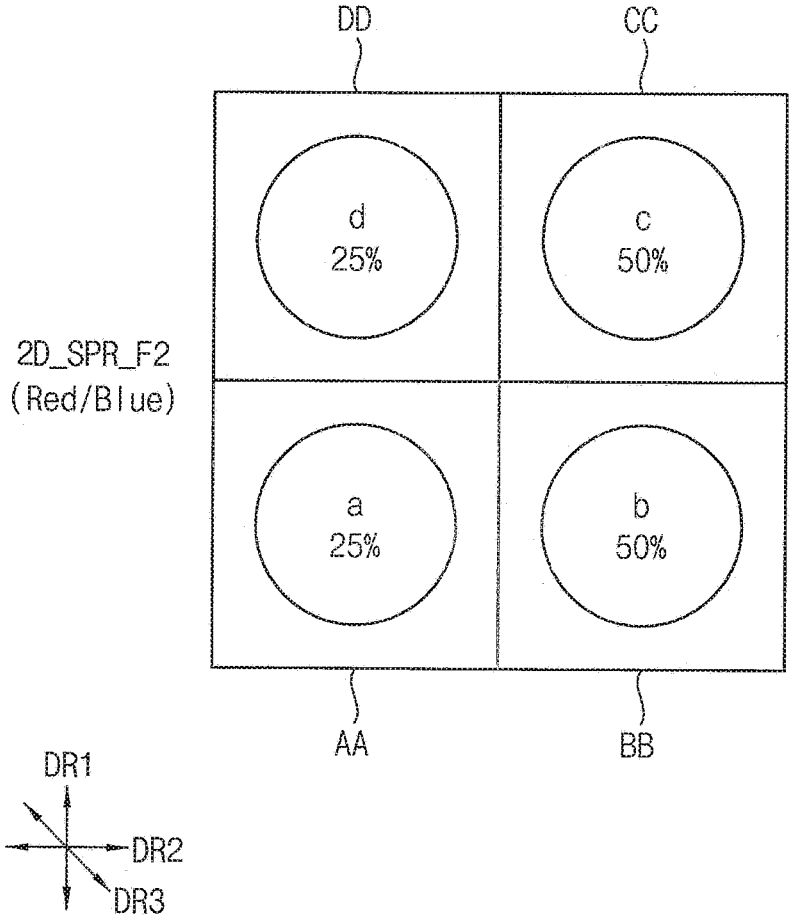
FIG. 13 is a conceptual diagram for describing a two-dimensional sub-pixel rendering filter applied to a vertical rendering unit shown in FIG. 9.

FIG. 13 is a conceptual diagram for describing a two-dimensional sub-pixel rendering filter applied to a vertical rendering unit shown in FIG. 9.

Referring to FIG. 13, for example, a second two-dimensional sub-pixel rendering filter 2D_SPR_F2 may be a 2×2 rendering filter.

The second two-dimensional sub-pixel rendering filter 2D_SPR_F2 may distribute red luminance data and blue luminance data for pixels arranged in the 2×2 configuration.

For example, in the second two-dimensional sub-pixel rendering filter 2D_SPR_F2, a reference pixel BB may have a first filter coefficient (b), a first neighboring pixel AA adjacent to the reference pixel BB in the horizontal direction DR2 may have a second filter coefficient (a), a second neighboring pixel CC adjacent to the reference pixel BB in the vertical direction DR1 may have a third filter coefficient (c), and a third neighboring pixel DD adjacent to the reference pixel BB in the diagonal direction DR3 may have a fourth filter coefficient (d). The first filter coefficient (b) may be 50%, the second filter coefficient (a) may be 25%, the third filter coefficient (c) may be 50%, and the fourth filter coefficient (d) may be 25%.

The sum of the filter coefficients filter_sum of the second two-dimensional sub-pixel rendering filter 2D_SPR_F2 may be greater than 1 as shown in [Equation 1]. If the sum of the filter coefficients filter_sum is greater than or equal to 1, the sum of the filter coefficients filter_sum may be determined as 1, and if the sum of the filter coefficients filter_sum is less than 1, the sum of the filter coefficients may be determined as the sum of the filter coefficients filter_sum.

Meanwhile, the rendering filter may not be applied to the green luminance data of the pixels arranged in the 2×2 configuration. In this case, the green luminance data of the pixels may be distributed at 100%.

Figure 14:
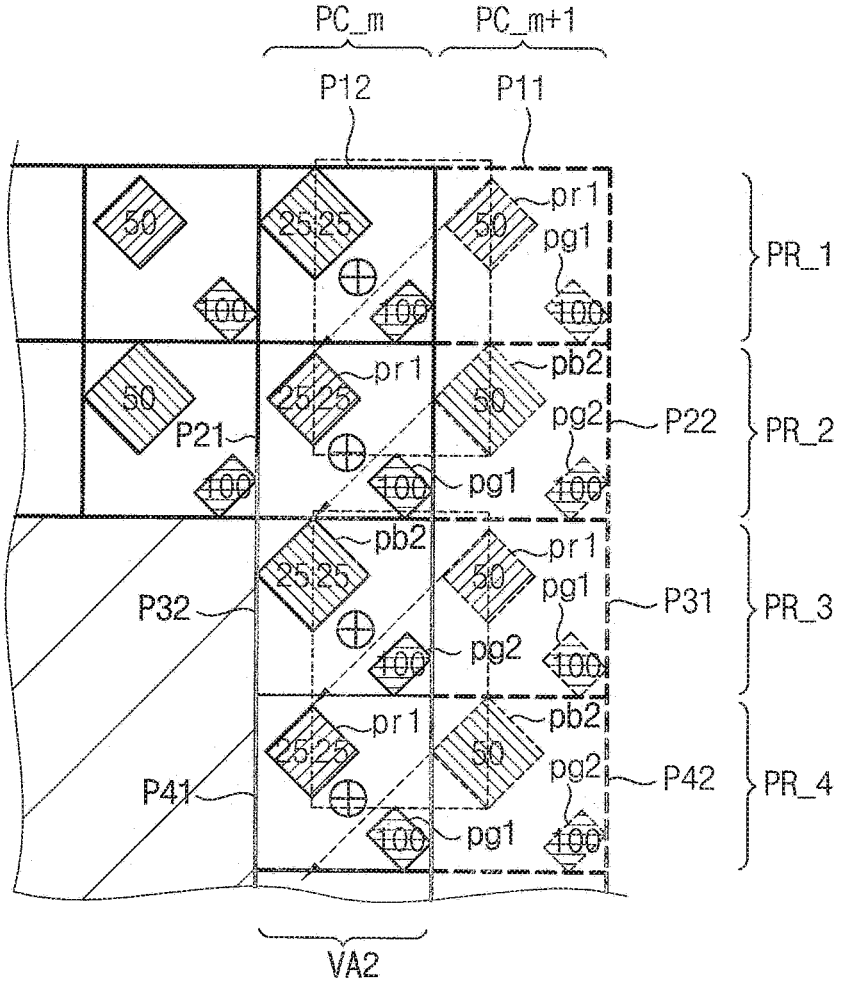
FIGS. 14 and 15 are conceptual diagrams for describing a rendering method of a vertical rendering unit shown in FIG. 9.
Figure 15:
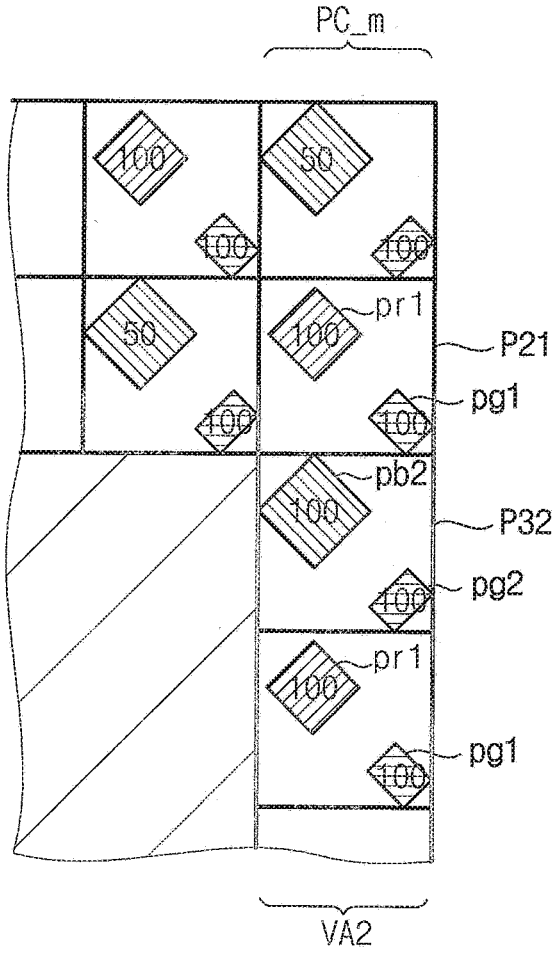

FIGS. 14 and 15 are conceptual diagrams for describing a rendering method of a vertical rendering unit shown in FIG. 9.

Referring to FIGS. 13 and 14, the second vertical line of the white solid line box WB may be displayed by first and second pixels P21 and P32 included in the $m^{th}$ pixel column PC_m corresponding to the second vertical line area VA2.

In an example embodiment, the buffer unit may store red, green and blue luminance data corresponding to pixels included in the last $m^{th}$ pixel column PC_m corresponding to the second vertical line.

The vertical rendering unit may distribute data to the red and green luminance data or blue and green luminance data of the pixels included in the $m^{th}$ pixel column PC_m by using red, green, and blue luminance data of pixels corresponding to the $m^{th}$ pixel column PC_m stored in the buffer unit as the red, green, and blue luminance data corresponding to the pixels of an $(m+1)^{th}$ pixel column PC_m+1 which is an absent pixel column that is not physically present in the display unit 100.

First, the vertical rendering unit may distribute the red and green luminance data or blue and green luminance data for the $m^{th}$ pixel column PC_m and the $(m+1)^{th}$ pixel column PC_m+1 by using the second two-dimensional sub-pixel rendering filter 2D_SPR_F2.

Referring to first and second pixel rows PR_1 and PR_2 of the $m^{th}$ and $(m+1)^{th}$ pixel columns PC_m and PC_m+1, the second pixel P12 may have 50% second blue luminance data pb2 in which 25% blue luminance data of the second pixel P12 is added up to 25% blue luminance data of the neighboring pixel and the second green luminance data pg2 in which the green luminance data of the first pixel is distributed at 100%. The first pixel P21 of the $m^{th}$ pixel column PC_m may have 50% first red luminance data pr1 in which 25% red luminance data of the first pixel P21 is added up to 25% red luminance data of the neighboring pixel and the first green luminance data pg1 in which the green luminance data of the second pixel is distributed at 100%.

The first pixel P11 of the $(m+1)^{th}$ pixel column PC_m+1 may have the first red luminance data pr1 in which the red luminance data of the first pixel P11 is distributed at 50% and the first green luminance data pg1 in which the green luminance data of the first pixel P11 is distributed at 100%. The second pixel P22 of the $(m+1)^{th}$ pixel column PC_m+1 may have the second blue luminance data pb2 in which the blue luminance data of the second pixel P22 is distributed at 50% and the second green luminance data pg2 in which the green luminance data of the second pixel P22 is distributed at 100%.

Referring to third and fourth pixel rows PR_3 and PR_4 of the $m^{th}$ and $(m+1)^{th}$ pixel columns PC_m and PC_m+1, the second pixel P32 of the $m^{th}$ pixel column PC_1 may have 50% second blue luminance data pb2 in which 25% blue luminance data of the second pixel P32 is added up to 25% blue luminance data of the neighboring pixel and the second green luminance data pg2 in which the green luminance data of the second pixel P32 is distributed at 100%. The first pixel P41 of the $m^{th}$ pixel column PC_m may have 50% first red luminance data pr1 in which 25% red luminance data of the first pixel P41 is added up to 25% red luminance data of the neighboring pixel and the first green luminance data pg1 in which the green luminance data of the first pixel P41 is distributed at 100%.

The first pixel P31 of the $(m+1)^{th}$ pixel column PC_m+1 may have the first red luminance data pr1 in which the red luminance data of the first pixel P31 is distributed at 50% and the first green luminance data pg1 in which the green luminance data of the first pixel P31 is distributed at 100%. The second pixel P42 of the $(m+1)^{th}$ pixel column PC_m+1 may have the second blue luminance data pb2 in which the blue luminance data of the second pixel P42 is distributed at 50% and the second green luminance data pg2 in which the green luminance data of the second pixel P42 is distributed at 100%.

In this manner, the luminance data for the first and second pixels P21, P22, P31, and P32 included in the $m^{th}$ pixel column PC_m and the $(m+1)^{th}$ pixel column PC_m+1 may be distributed.

Then, the vertical rendering unit may add up the 50% first red luminance data pr1 and the second blue luminance data pb2 distributed in the first and second pixels P11 and P22 included in the $(m+1)^{th}$ pixel column PC_m+1 to the 50% first red luminance data pr1 and the second blue luminance data pb2 distributed in the first and second pixels P21, P32, and P41 corresponding to the $m^{th}$ pixel column PC_m.

Referring to FIGS. 14 and 15, the 50% first red luminance data pr1 distributed in the first pixel P11 included in the first pixel row PR_1 of the $(m+1)^{th}$ pixel column PC_m+1 may be added up to the 50% first red luminance data pr1 distributed in the first pixel P21 included in the second pixel row PR_2 of the $m^{th}$ pixel column PC_m, so that the first pixel P21 included in the second pixel row PR_2 of the $m^{th}$ pixel column PC_m may have the first red luminance data pr1 of 100%.

In addition, the 50% second blue luminance data pb2 distributed in the second pixel P22 included in the second pixel row PR_2 of the $(m+1)^{th}$ pixel column PC_m+1 may be added up to the 50% second blue luminance data pb2 distributed in the second pixel P32 included in the third pixel row PR_3 of the $m^{th}$ column PC_m and the second pixel P32 included in the pixel row PR_3 of the $m^{th}$ column PC_m may have the second blue luminance data pb2 of 100%.

In this manner, the red and blue luminance data distributed in the first and second pixels included in the $m^{th}$ pixel column PC_m may be added up to the red and blue luminance data distributed in the first and second pixels included in the $(m+1)^{th}$ pixel column PC_m+1, so that the second vertical line VL2 of the white solid line shown in FIG. 3A may be displayed as white by the first and second pixels P21, P32 and P41 included in the $m^{th}$ pixel column PC_m.

According to the above embodiment, when the white solid line box WB is displayed on an outer portion of the display unit, the luminance distribution defect caused by the physical pixel shortage can be prevented at the vertical line portion of the white solid line box WB.

Figure 16:
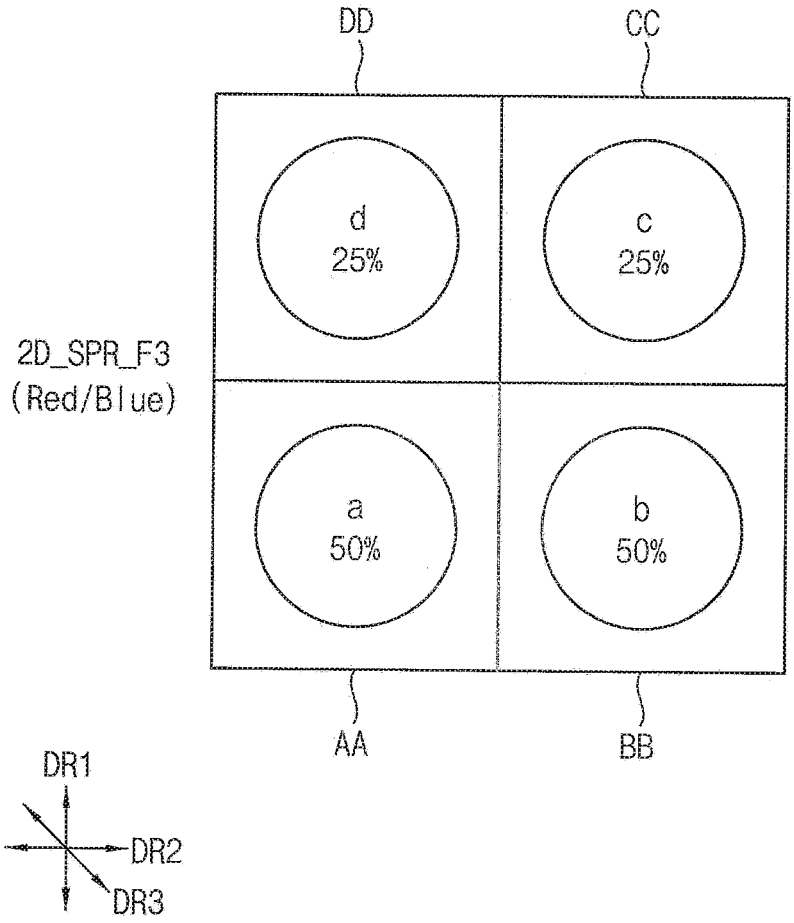
FIG. 16 is a conceptual diagram for describing a two-dimensional sub-pixel rendering filter applied to a horizontal rendering unit shown in FIG. 9.

FIG. 16 is a conceptual diagram for describing a two-dimensional sub-pixel rendering filter applied to a horizontal rendering unit shown in FIG. 9.

Referring to FIG. 16, for example, a third two-dimensional sub-pixel renderer 2D_SPR_F3 may be a 2×2 rendering filter.

The third two-dimensional sub-pixel rendering filter 2D_SPR_F3 may distribute the red luminance data and blue luminance data for pixels arranged in the 2×2 configuration.

For example, in the third two-dimensional sub-pixel rendering filter 2D_SPR_F3, a reference pixel BB may have a first filter coefficient (b), a first neighboring pixel AA adjacent to the reference pixel BB in the horizontal direction DR2 may have a second filter coefficient (a), a second neighboring pixel CC adjacent to the reference pixel BB in the vertical direction DR1 may have a third filter coefficient (c), and a third neighboring pixel DD adjacent to the reference pixel BB in a diagonal direction DR3 may have a fourth filter coefficient (d). The first filter coefficient (b) may be 50%, the second filter coefficient (a) may be 50%, the third filter coefficient (c) may be 25%, and the fourth filter coefficient (d) may be 25%.

The sum of the filter coefficients filter_sum of the third two-dimensional sub-pixel rendering filter 2D_SPR_F3 may be greater than 1 as shown in [Equation 1]. If the sum of the filter coefficients filter_sum is greater than or equal to 1, the sum of the filter coefficients filter_sum may be determined as 1, and if the sum of the filter coefficients filter_sum is less than 1, the sum of the filter coefficients may be determined as the sum of the filter coefficients filter_sum.

Meanwhile, the rendering filter may not be applied to the green luminance data of the pixels arranged in the 2×2 configuration. In this case, the green luminance data of the pixels may be distributed at 100%.

Figure 17:
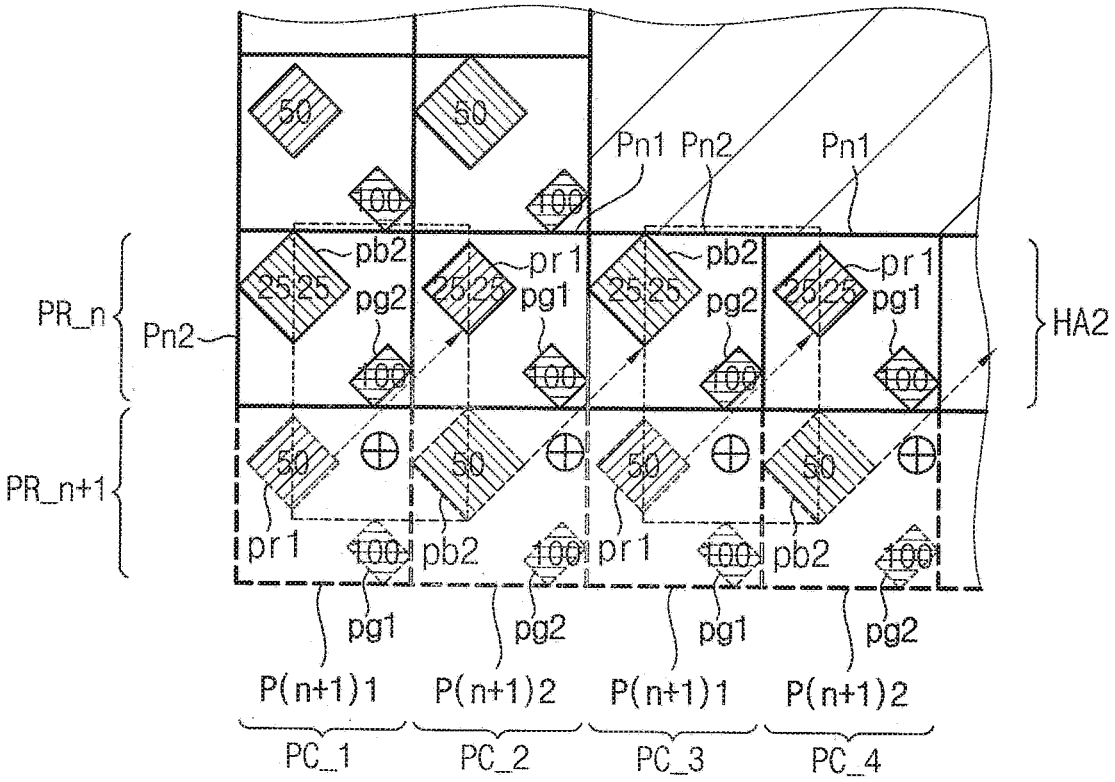
FIGS. 17 and 18 are conceptual diagrams for describing a rendering method of a horizontal rendering unit shown in FIG. 9.
Figure 18:
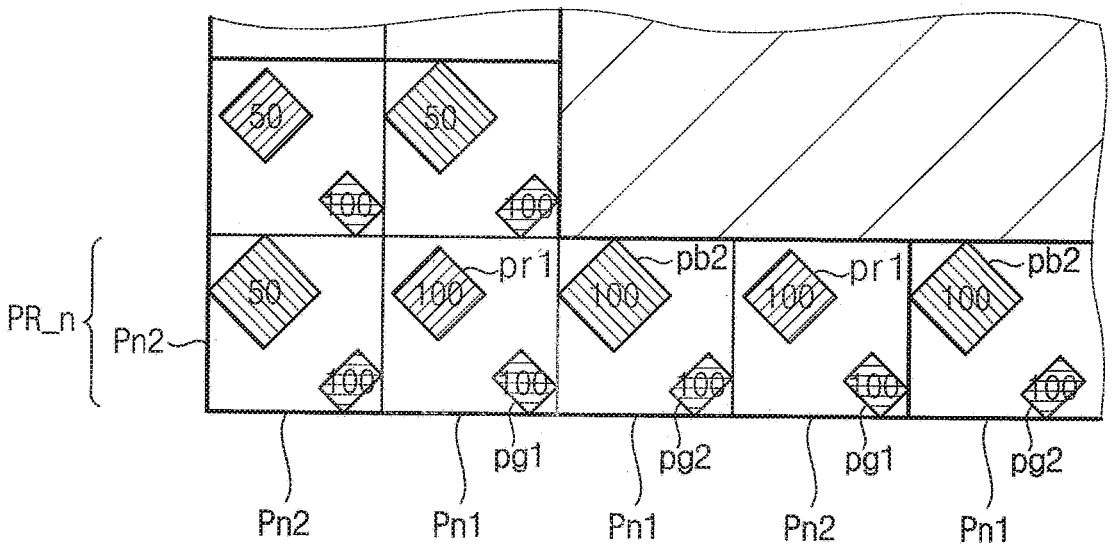

FIGS. 17 and 18 are conceptual diagrams for describing a rendering method of a horizontal rendering unit shown in FIG. 9.

Referring to FIGS. 16 and 17, the second horizontal line of the white solid line box WB may be displayed by the first and second pixels Pn1 and Pn2 included in the $n^{th}$ pixel row PR_n, which is the last pixel row corresponding to the second horizontal line area HA2.

In an example embodiment, the buffer unit may store red, green, and blue luminance data of pixels included in the last $n^{th}$ pixel row PR_n corresponding to the second horizontal line.

The horizontal rendering unit may distribute data to the red and green luminance data or blue and green luminance data of the pixels included in an $n^{th}$ pixel row PR_n by using red, green, and blue luminance data of pixels corresponding to the $n^{th}$ pixel row PR_n stored in the buffer unit as the red, green, and blue luminance data corresponding to the pixels of an $(n+1)^{th}$ pixel row PR_n+1 which is an absent pixel column that is not physically present in the display unit 100.

First, the horizontal rendering unit may distribute the red and green luminance data or blue and green luminance data for the pixels included in the $n^{th}$ pixel row PR_n and an $(n+1)^{th}$ pixel row PR_n+1 by using the third two-dimensional rendering filter 2D_SPR_F3.

Referring to first and second pixel columns PC_1 and PC_2 of the $n^{th}$ pixel row PR_n and the $(n+1)^{th}$ pixel row PR_n+1, a first pixel Pn1 of the $n^{th}$ pixel row PR_n may have the 50% first red luminance data pr1 in which 25% red luminance data of the first pixel is added up to 25% red luminance data of the neighboring pixel and the first green luminance data pg1 in which the green luminance data of the first pixel is distributed at 100%. A second pixel Pn2 of the $n^{th}$ pixel row PR_n may have the 50% second blue luminance data pb2 in which 25% blue luminance data of the second pixel is added up to 25% blue luminance data of the neighboring pixel and the second green luminance data pg2 in which the green luminance data of the second pixel is distributed at 100%.

A first pixel P(n+1)1 of the $(n+1)^{th}$ pixel row PR_n+1 may have the first red luminance data pr1 in which the red luminance data of the first pixel is distributed at 50% and the first green luminance data pg1 in which the green luminance data of the first pixel is distributed at 100%. A second pixel P(n+1)2 of the $(n+1)^{th}$ pixel row PR_n+1 may have the second blue luminance data pb2 in which the blue luminance data of the second pixel is distributed at 50% and the second green luminance data pg2 in which the green luminance data of the second pixel is distributed at 100%.

In this manner, the luminance data may be distributed for the first and second pixels Pn1, Pn2, P(n+1)1 and P(n+1)2 included in the $n^{th}$ and $(n+1)^{th}$ pixel rows PR_n and PR_n+1.

Referring to FIGS. 17 and 18, the 50% first red luminance data pr1 distributed in the first pixel P(n+1)1 included in the first pixel column PC_1 of the $(n+1)^{th}$ pixel row PR_n+1 may be added up to the 50% first red luminance data pr1 distributed in the first pixel Pn1 included in the second pixel column PC_2 of the $n^{th}$ pixel row PR_n and the first pixel Pn1 of the $n^{th}$ pixel row PR_n may have the first red luminance data pr1 of 100%.

In addition, the 50% second blue luminance data pb2 distributed in the second pixel P(n+1)2 included in the second pixel column PC_2 of the $(n+1)^{th}$ pixel row PR_n+1 may be added up to the 50% second blue luminance data pb2 distributed in the second pixel Pn2 included in the third pixel column PC_3 of the $n^{th}$ pixel row PR_n and the second pixel Pn2 of the $n^{th}$ pixel row PR_n may have the second blue luminance data pb2 of 100%.

In this manner, the red and blue luminance data of the first and second pixels included in the $n^{th}$ pixel row PR_n may be added up to the red and blue luminance data of the first and second pixels included in the $(n+1)^{th}$ pixel row PR_n+1 so that the second horizontal line HL2 of the white solid line box WB shown in FIG. 3A may be displayed as white by the first and second pixels Pn1 and Pn2 included in the $n^{th}$ pixel row PR_n.

As described above, according to example embodiments, when the white solid line box is displayed on the outside of the display unit, the luminance distribution defect caused by the physical pixel shortage can be prevented at the horizontal line portion of the white solid line box.

The present inventive concept may be applied to a display device (e.g., an organic light emitting display device). For example, the present inventive concept may be applied to a computer, a laptop, a cellular phone, a smart phone, a smart pad, a portable multimedia player (PMP), a personal digital assistant (PDA), an MP3 player, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display unit including a first pixel having a first color sub-pixel and a second color sub-pixel and a second pixel having a third color sub-pixel and another second color sub-pixel;

an input gamma unit configured to convert first color grayscale data, second color grayscale data, and third color grayscale data into first color luminance data, second color luminance data, and third color luminance data;

a buffer unit configured to store the first color luminance data, the second color luminance data, and the third color luminance data of a last pixel column of the display unit;

a vertical rendering unit configured to increase the first color luminance data and the third color luminance data of the last pixel column by using the first color luminance data, the second color luminance data, and the third color luminance data of the last pixel column stored in the buffer unit as first color luminance data and third color luminance data of an absent pixel column adjacent to the last pixel column; and an output gamma unit configured to convert the first color luminance data, the second color luminance data, and the third color luminance data into the first color grayscale data and the second color grayscale data or the third color grayscale data and the second color grayscale data.

2. The display device of claim 1, further comprising:

a normal rendering unit configured to distribute the first color luminance data and the third color luminance data by applying a one-dimensional sub-pixel rendering filter to the first color luminance data and the third color luminance data of the first and second pixels.

3. The display device of claim 1, wherein the vertical rendering unit distributes the first color luminance data and the third color luminance data of the last pixel column and the absent pixel column by applying a two-dimensional sub-pixel rendering filter to the first color luminance data and the third color luminance data of the last pixel column and the absent pixel column, adds up the distributed first color luminance data of the absent pixel column to the distributed first color luminance data of the last pixel column, and adds up the distributed third color luminance data of the absent pixel column to the distributed third color luminance data of the last pixel column.

4. The display device of claim 3, wherein a sum of filter coefficients of the two-dimensional sub-pixel rendering filter is greater than or equal to 1.

5. The display device of claim 1, further comprising:

a normal rendering unit configured to distribute the first color luminance data and the third color luminance data by applying a first two-dimensional sub-pixel rendering filter to the first color luminance data and the third color luminance data of the first and second pixels.

6. The display device of claim 5, wherein the buffer unit further stores first color luminance data, second color luminance data, and third color luminance data of a last pixel row of the display unit.

7. The display device of claim 6, further comprising:

a horizontal rendering unit configured to increase the first color luminance data and the third color luminance data of the last pixel row by using the first color luminance data, the second color luminance data, and the third color luminance data of the last pixel row stored in the buffer unit as first color luminance data and third color luminance data of an absent pixel row adjacent to the last pixel row.

8. The display device of claim 7, wherein the horizontal rendering unit distributes the first color luminance data and the third color luminance data of the last pixel row and the absent pixel row by applying a third two-dimensional sub-pixel rendering filter to the first color luminance data and the third color luminance data of the last pixel row and the absent pixel row, adds up the distributed first color luminance data of the absent pixel row to the distributed first color luminance data of the last pixel row, and adds up the distributed third color luminance data of the absent pixel row to the distributed third color luminance data of the last pixel row.

9. The display device of claim 8, wherein a sum of filter coefficients of the third two-dimensional sub-pixel rendering filter is greater than or equal to 1.

10. The display device of claim 5, wherein the vertical rendering unit distributes the first color luminance data and the third color luminance data of the last pixel column and the absent pixel column by applying a second two-dimensional sub-pixel rendering filter to the first color luminance data and the third color luminance data of the last pixel column and the absent pixel column, adds up the distributed first color luminance data of the absent pixel column to the distributed first color luminance data of the last pixel column, and adds up the distributed third color luminance data of the absent pixel column to the distributed third color luminance data of the last pixel column.

11. The display device of claim 10, wherein a sum of filter coefficients of the second two-dimensional sub-pixel rendering filter is greater than or equal to 1.

12. A method of driving a display device including a display unit that includes a first pixel having a first color sub-pixel and a second color sub-pixel and a second pixel having a third color sub-pixel and another second color sub-pixel, the method comprising:

converting first color grayscale data, second color grayscale data, and third color grayscale data into first color luminance data, second color luminance data, and third color luminance data;

storing first color luminance data, second color luminance data, and third color luminance data of a last pixel column of the display unit in a buffer unit;

increasing the first color luminance data and the third color luminance data of the last pixel column by using the first color luminance data, the second color luminance data, and the third color luminance data of the last pixel column stored in the buffer unit as first color luminance data and third color luminance data of an absent pixel column adjacent to the last pixel column; and converting the first color luminance data, the second color luminance data, and the third color luminance data into the first color grayscale data and the second color grayscale data or the third color grayscale data and the second color grayscale data.

13. The method of claim 12, further comprising:

distributing the first color luminance data and the third color luminance data by applying a one-dimensional sub-pixel rendering filter to the first color luminance data and the third color luminance data of the first and second pixels.

14. The method of claim 12, further comprising:

distributing the first color luminance data and the third color luminance data of the last pixel column and the absent pixel column by applying a two-dimensional sub-pixel rendering filter to the first color luminance data and the third color luminance data of the last pixel column and the absent pixel column;

adding up the distributed first color luminance data of the absent pixel column to the distributed first color luminance data of the last pixel column; and adding up the distributed third color luminance data of the absent pixel column to the distributed third color luminance data of the last pixel column.

15. The method of claim 12, further comprising:

distributing the first color luminance data and the third color luminance data by applying a first two-dimensional sub-pixel rendering filter to the first color luminance data and the third color luminance data of the first and second pixels.

16. The method of claim 12, further comprising:

distributing the first color luminance data and the third color luminance data of the last pixel column and the absent pixel column by applying a second two-dimensional sub-pixel rendering filter to the first color luminance data and the third color luminance data of the last pixel column and the absent pixel column;

adding up the distributed first color luminance data of the absent pixel column to the distributed first color luminance data of the last pixel column; and adding up the distributed third color luminance data of the absent pixel column to the distributed third color luminance data of the last pixel column.

17. The method of claim 16, further comprising:

storing first color luminance data, second color luminance data, and third color luminance data of a last pixel row of the display unit in the buffer unit.

18. The method of claim 17, further comprising:

increasing the first color luminance data and the third color luminance data of the last pixel row by using the first color luminance data, the second color luminance data, and the third color luminance data of the last pixel row stored in the buffer unit as first color luminance data and third color luminance data of an absent pixel row adjacent to the last pixel row.

19. The method of claim 18, further comprising:

distributing the first color luminance data and the third color luminance data of the last pixel row and the absent pixel row by applying a third two-dimensional sub-pixel rendering filter to the first color luminance data and the third color luminance data of the last pixel row and the absent pixel row;

adding up the distributed first color luminance data of the absent pixel row to the distributed first color luminance data of the last pixel row; and adding up the distributed third color luminance data of the absent pixel row to the distributed third color luminance data of the last pixel row.

20. The method of claim 19, wherein a sum of filter coefficients of each of the second and third two-dimensional sub-pixel rendering filters is greater than or equal to 1.

* * * * *